US007740998B2

(12) United States Patent
Yamazaki et al.

(10) Patent No.: US 7,740,998 B2
(45) Date of Patent: Jun. 22, 2010

(54) POSITIVELY CHARGEABLE DEVELOPER

(75) Inventors: Katsuhisa Yamazaki, Numazu (JP); Daisuke Yoshiba, Sunto-gun (JP); Masami Fujimoto, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 1138 days.

(21) Appl. No.: 11/354,850

(22) Filed: Feb. 16, 2006

(65) Prior Publication Data

US 2006/0160006 A1 Jul. 20, 2006

Related U.S. Application Data

(63) Continuation of application No. PCT/JP2005/021636, filed on Nov. 18, 2005.

(30) Foreign Application Priority Data

Nov. 19, 2004 (JP) ..... 2004-335385
Nov. 19, 2004 (JP) ..... 2004-335421

(51) Int. Cl.
*G03G 9/083* (2006.01)

(52) U.S. Cl. ..... 430/106.2; 430/108.6; 430/111.4; 430/122.51; 430/123.41; 430/123.42; 430/125.51

(58) Field of Classification Search ..... 430/106.1, 430/106.2, 108.6, 111.4, 122.51, 123.41, 430/123.42, 123.51, 123.56
See application file for complete search history.

(56) References Cited

U.S. PATENT DOCUMENTS

| | | | | |
|---|---|---|---|---|
| 2,297,691 | A | 10/1942 | Carlson | |
| 5,641,601 | A | 6/1997 | Mitani et al. | 430/106.6 |
| 5,705,305 | A | 1/1998 | Ohta et al. | |
| 6,670,087 | B2 * | 12/2003 | Fujikawa et al. | 430/109.2 |
| 6,686,110 | B2 | 2/2004 | Kadota | 430/108.3 |
| 7,018,762 | B2 | 3/2006 | Kadota | 430/108.6 |
| 7,150,953 | B2 | 12/2006 | Yamazaki et al. | 430/108.3 |
| 2005/0106485 | A1 * | 5/2005 | Yamazaki et al. | 430/106.1 |
| 2006/0088780 | A1 | 4/2006 | Kadota | 430/108.6 |
| 2006/0275687 | A1 | 12/2006 | Kadota | 430/108.6 |
| 2006/0283782 | A1 | 12/2006 | Kadota | 209/20 |

FOREIGN PATENT DOCUMENTS

| | | | |
|---|---|---|---|
| JP | 42-023910 | | 11/1967 |
| JP | 43-024748 | | 10/1968 |
| JP | 01-219762 | | 9/1989 |
| JP | 04-083258 | | 3/1992 |
| JP | 04-083259 | | 3/1992 |
| JP | 04-142560 | | 5/1992 |
| JP | 04/217262 | | 8/1992 |
| JP | 04-269763 | | 9/1992 |
| JP | 04-350665 | | 12/1992 |
| JP | 06-093136 | | 11/1994 |
| JP | 06-093137 | | 11/1994 |
| JP | 07-230182 | | 8/1995 |
| JP | 08/137125 | | 5/1996 |
| JP | 08-202081 | | 8/1996 |
| JP | 08-286421 | | 11/1996 |
| JP | 09/190007 | | 7/1997 |
| JP | 09-244398 | | 9/1997 |
| JP | 2001-034006 | | 2/2001 |
| JP | 2001-034015 | | 2/2001 |
| JP | 2001-083738 | A * | 3/2001 |
| JP | 2002-207314 | | 7/2002 |
| JP | 2002-365828 | | 12/2002 |
| JP | 2003-280253 | | 10/2003 |
| JP | 2003-280254 | | 10/2003 |
| JP | 2004/191532 | | 7/2004 |

OTHER PUBLICATIONS

USPTO Trademark Electronic Search System (TESS) file for trademark Coulter Counter, Serial No. 72062272, printed on Sep. 16, 2009.*

Japanese Patent Office machine-assisted translation of JP 2001-083738 A (pub. Mar. 2001).*

Translation of International Preliminary Report on Patentability in PCT/JP2005/021636 issued by WIPO on May 22, 2007.

* cited by examiner

*Primary Examiner*—Janis L Dote
(74) *Attorney, Agent, or Firm*—Fitzpatrick, Cella, Harper & Scinto

(57) ABSTRACT

A positively chargeable developer is provided which is capable of providing stable image quality without causing any image defect even in long-term use. The developer includes at least positively chargeable toner particles each containing at least a binder resin and magnetic iron oxide, silica and an inorganic fine powder. A unconfined yield strength at a major consolidation stress of 5 kPa of the developer is in the range of 0.1 to 2.5 kPa, and a unconfined yield strength at a major consolidation stress of 20 kPa of the developer is in the range of 2.5 to 5.5 kPa.

13 Claims, 5 Drawing Sheets

POSITIVELY CHARGEABLE DEVELOPER

This application is a continuation of International Application No. PCT/JP2005/021636 filed on Nov. 18, 2005, which claims the benefit of Japanese Patent Application Nos. 2004-335421 filed on Nov. 19, 2004 and 2004-335385 filed on Nov. 19, 2004.

BACKGROUND OF THE INVENTION

1. Field of the Invention

The present invention relates to a developer to be used for electrophotography and toner jet, and to an image forming method and an image forming apparatus for visualizing an electrostatic charge image.

2. Related Background Art

A large number of methods such as an electrostatic recording method, a magnetic recording method, and a toner jet method have been conventionally known as image forming methods. For example, as described in U.S. Pat. No. 2,297,691, JP-B-S42-023910, and JP-B-S43-024748, a large number of methods have been known as electrophotographic methods. A general electrophotographic method involves: using a photoconductive substance; forming an electrical latent image on a photosensitive member by using various means; developing the latent image with toner to provide a visible image; transferring the toner onto a transfer material such as paper as required; and fixing the toner image on the transfer material by means of heat, pressure, or the like to provide a copy. The toner remaining on the photosensitive member without being transferred is cleaned by various methods, and the above steps are repeated.

In recent years, a reduced size, a reduced weight, an increased speed, and higher reliability have been strictly pursued for such copying device. For example, such copying machine has began to be used not only for paperwork for copying an original but also for: a digital printer as an output unit of a computer; copying a highly compact image such as a graphic design; and near-print where higher reliability is required (print-on-demand applications, where various kinds can be printed in a small amount, ranging from the editing of a document by means of a computer to the copying and book-binding of the document). Therefore, high definition and high image quality have been demanded. As a result, performance required for toner has become sophisticated.

For example, JP-A-H07-230182 and JP-A-H08-286421 each propose that the external addition of a magnetic powder stabilizes chargeability. According to this method, toner with stabilized chargeability and high cleaning properties can be surely obtained. However, in applications in which a high speed and improved definition and improved image quality which have been required in recent years, the method is insufficient not only because developability is insufficient but also because adhesion to a charging member occurs. In addition, JP-B-H06-093136 and JP-B-H06-093137 each propose that the addition of a charge relaxing agent to magnetic toner with a specified particle size distribution maintains high image quality while suppressing the excessive charging of the toner. Furthermore, JP-A-H08-137125 proposes that an inorganic fine particle is stuck to the surface of a toner base particle to make a potential difference between the surface of the toner base particle and the surface of the toner equal to or larger than a certain value, thereby alleviating the unevenness of charges on the surface of the toner and providing uniform charging. JP-A-2001-034006 and JP-A-2002-0207314 each propose that toner with good chargeability can be obtained by controlling the coverage of the surface of the toner with a specific inorganic fine particle and the liberation ratio of the particle from the surface of the toner. In addition, JP-A-2003-280253, JP-A-2003-280254, JP-A-H04-083258, JP-A-H04-083259, JP-A-H04-142560, JP-A-H04-269763, and JP-A-H04-350665 each propose that a magnesium oxide fine powder is added to toner to improve fluidity, whereby good chargeability can be obtained and environment dependence can be reduced.

Each of those proposals has an effect of improving chargeability. However, room is still left for each of them to be improved in applications in which a high speed and improved definition and improved image quality which have been required in recent years, i.e., applications in which even a method of use that is apt to cause toner deterioration owing to high-speed printing is required to provide image quality with high reliability and stability.

SUMMARY OF THE INVENTION

An object of the present invention is to provide a developer that has solved the above problems, and an image forming method using the developer.

Another object of the present invention is to provide a developer capable of providing stable image quality without causing any image defect even in long-term use, and an image forming method using the developer.

According to one aspect of the present invention, a positively chargeable developer is provided including at least positively chargeable toner particles each containing at least a binder resin and magnetic iron oxide, wherein a unconfined yield strength ($U_{5kPa}$) at a major consolidation stress of 5.0 kPa of the developer satisfies the relationship of 0.1 kPa$\leqq U_{5kPa} \leqq$2.5 kPa; and a unconfined yield strength ($U_{20kPa}$) at a major consolidation stress of 20.0 kPa of the developer satisfies the relationship of 2.5 kPa$\leqq U_{20kPa} \leqq$5.5 kPa.

In a further aspect of the developer of the present invention, an inorganic fine powder is preferably externally added to the positively chargeable toner particles.

In a further aspect of the present invention, the inorganic fine powder is preferably a fine powder of at least one oxide selected from zinc oxide, alumina, and magnesium oxide.

In a further aspect of the present invention, the inorganic fine powder is preferably a magnesium oxide fine powder, the magnesium oxide fine powder is preferably a crystal system having a peak at a Bragg angle (2θ±0.2 deg) of 42.9 deg in CuKα characteristic X-ray diffraction, and the half width of the X-ray diffraction peak at the Bragg angle (2θ±0.2 deg) of 42.9 deg is preferably 0.40 deg or less.

In a further aspect of the present invention, the volume average particle size (A) of the magnesium oxide fine powder preferably satisfies the relationship of 0.1 μm$\leqq$A$\leqq$2.0 μm, a volume distribution cumulative value of the magnesium oxide fine powder having a particle size equal to or smaller than one half the volume average particle size is preferably 10 vol % or less, and a volume distribution cumulative value of the magnesium oxide fine powder having a particle size equal to or larger than twice the volume average particle size is preferably 10 vol % or less.

In a further aspect of the present invention, the isoelectric point of the magnesium oxide fine powder is preferably 8 to 14.

In a further aspect of the present invention, the specific surface area of the magnesium oxide fine powder is preferably 1.0 to 15.0 $m^2/g$.

In a further aspect of the present invention, the MgO content in the magnesium oxide fine powder is preferably 98.00% or more.

In a further aspect of the present invention, the content (B) of the inorganic fine powder preferably satisfies the relationship of 0.01 mass %≦B≦2.00 mass % on the basis of the entirety of the developer.

In a further aspect of the present invention, the liberation ratio (C) of the inorganic fine powder preferably satisfies the relationship of 0.1%≦C≦5.0%.

In a further aspect of the present invention, the difference between the zeta potential of the positively chargeable toner particles at pH of a dispersion liquid prepared by dispersing the positively chargeable toner particles into water and the zeta potential of the inorganic fine powder at the pH is preferably 40 mV or less.

In a further aspect of the present invention, the developer preferably contains a silica fine powder in addition to the inorganic fine powder.

In a further aspect of the present invention, when the wettability of the silica fine powder with a mixed solvent of methanol and water is measured in terms of transmittance of light having a wavelength of 780 nm, a methanol concentration (D) at a transmittance of 80% preferably satisfies the relationship of 65 vol %≦D≦80 vol %.

In a further aspect of the developer of the present invention, the acid value ($D_{av}$) of the developer preferably satisfies the relationship of 0.5 mgKOH/g≦$D_{av}$≦20.0 mgKOH/g.

In a further aspect of the present invention, a half width Y in relation to a peak particle size X in number-based particle size distribution with 256 channels by means of a COULTER COUNTER preferably satisfies the following relationship:

$$2.06\times X-9.0\leqq Y\leqq 2.06\times X-7.5$$

In a further aspect of the developer of the present invention, a main peak is preferably present in a molecular weight region of 3,000 or more to 30,000 or less in molecular weight distribution of THF soluble matter in the developer measured by gel permeation chromatography (GPC), and a peak area of a molecular weight region of 100,000 or less preferably accounts for 70 mass % or more of an entire peak area.

In a further aspect of the developer of the present invention, THF insoluble matter of the binder resin component resulting from Soxhlet extraction with tetrahydrofuran (THF) for 16 hours preferably satisfies the relationship of 0.1 mass %≦THF insoluble matter≦50.0 mass %.

In a further aspect of the developer of the present invention, the binder resin preferably has at least a styrene-type copolymer resin.

In a further aspect of the present invention, the developer preferably has a charge control agent, and the charge control agent is preferably at least one of a triphenylmethane compound and a quaternary ammonium salt.

In a further aspect of the present invention, the magnetic iron oxide preferably has an octahedral shape and/or a multinuclear shape.

In a further aspect of the present invention, the content (E) of magnetic iron oxide particles preferably satisfies the relationship of 20 parts by mass≦E≦200 parts by mass based on 100 parts by mass of the binder resin.

According to another aspect of the present invention, an image forming method is provided including at least a developing step of developing an electrostatic latent image formed on a latent image-bearing member with a developer layer formed on a developer carrying member to form a developer image, wherein torque (T) to be applied to the developer carrying member in a state that the developer layer is formed satisfies the relationship of 0.1 N·m≦T≦50 N·m; the developer is a positively chargeable developer including at least positively chargeable toner particles each containing at least a binder resin and magnetic iron oxide; a unconfined yield strength ($U_{5kPa}$) at a major consolidation stress of 5 kPa of the developer satisfies the relationship of 0.1 kPa≦$U_{5kPa}$≦2.5 kPa; and a unconfined yield strength ($U_{20kPa}$) at a major consolidation stress of 20 kPa of the developer satisfies the relationship of 2.5 kPa≦$U_{20kPa}$≦5.5 kPa.

In a further aspect of the image forming method of the present invention, the latent image-bearing member preferably includes: a conductive substrate; a photoconductive layer on the conductive substrate, the photoconductive layer containing at least amorphous silicon; and a surface protective layer on the photoconductive layer, the surface protective layer containing amorphous silicon and/or amorphous carbon and/or amorphous silicon nitride.

DESCRIPTION OF THE PREFERRED EMBODIMENTS

The inventors of the present invention have conducted researches on constituent materials to be used for a developer. As a result, they have found that controlling the powder property of a positively chargeable developer in a consolidation state can prevent the developer from deteriorating even in long-term use and provide stable image quality.

Furthermore, the inventors of the present invention have found that the powder property of a positively chargeable developer in a consolidation state can be easily controlled by controlling a relationship among a positively chargeable toner particle containing at least a binder resin and magnetic iron oxide, and silica and an inorganic fine powder.

The researches conducted by the inventors of the present invention have revealed that the powder property of a developer layer in a consolidation state is closely related to an image forming process in an electrophotographic process. In particular, it has been found that the powder property is a physical property indispensable for obtaining image quality with high reliability and stability when applied to a system in which toner is apt to deteriorate owing to high-speed printing. Hereinafter, the relationship between the powder property of a developer layer in a consolidation state and the image forming process will be described in connection with the image forming process.

Figure 1:
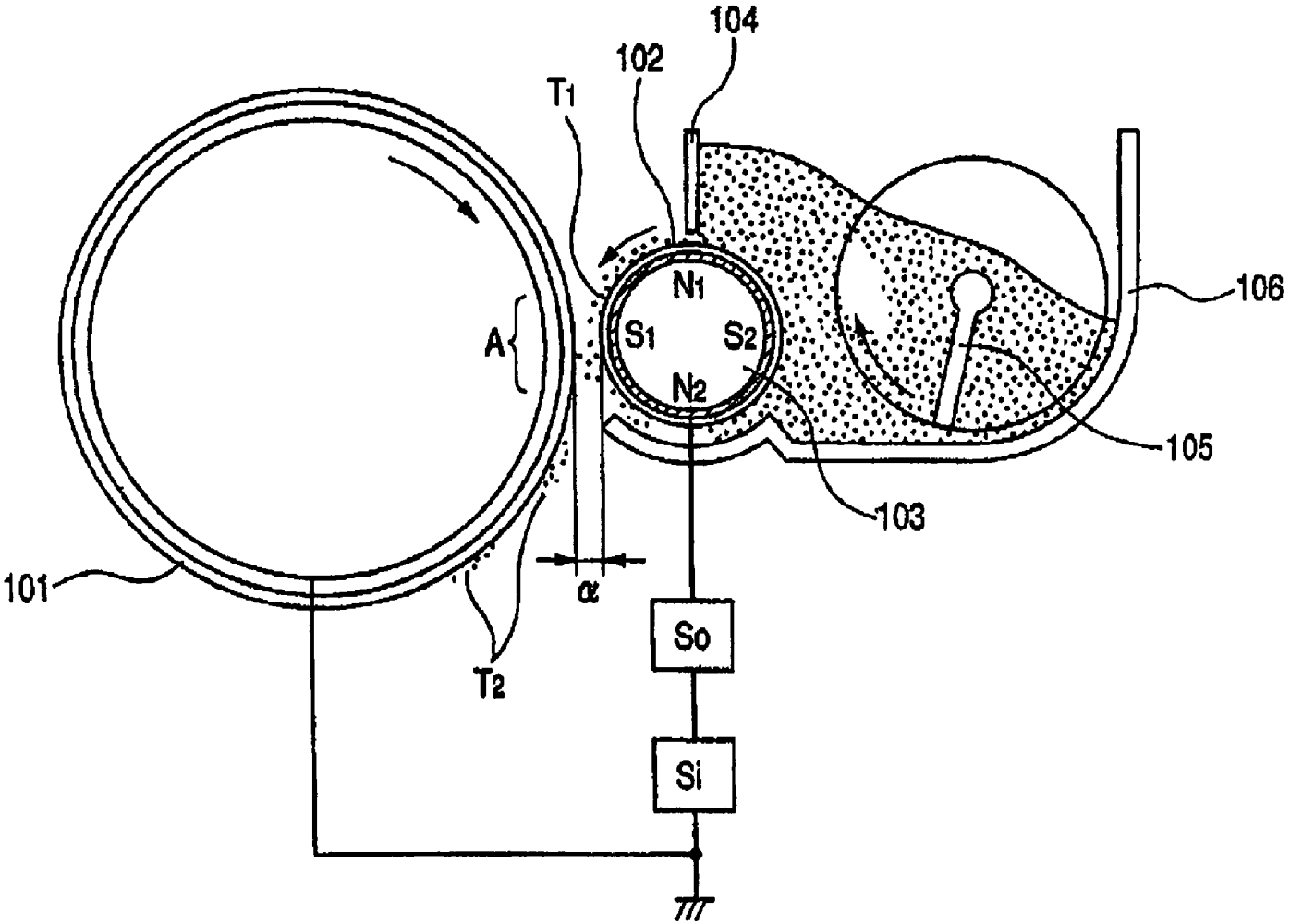
FIG. 1 is a schematic view showing an example of an image forming apparatus suitable for forming an image by means of the developer of the present invention.

In FIG. 1, substantially the right semi-peripheral surface of a developer carrying member 102 is always in contact with a developer reservoir in a developer container 106, and a developer near the surface of the developer carrying member adheres to and is held on the surface of the developer carrying member by the magnetic force of magnetism generating means 103 in the developer carrying member and/or electrostatic force. When the developer carrying member 102 is rotated, a developer layer on the surface of the developer carrying member is regulated to be a thin layer T1 having a uniform thickness at each part in the course of passing through the position of a developer regulating member 104. In order to regulate the layer thickness, the developer regulating member 104 composed of a ferromagnetic metal to serve as a developer layer thickness regulating member is hanged down from the surface of the developer carrying member 102 so as to be opposite to the developer carrying member 102 with a gap width of about 200 to 300 μm between the member and the surface. Lines of magnetic force from a magnetic pole N1 of the magnetism generating means 103 concentrate on the developer regulating member 104, whereby a thin layer of the developer (developer layer) is formed on the developer carrying member 102. The regulated developer layer T1 is preferably thinner than the minimum gap between the developer carrying member 102 and a latent image-bearing member (such as a photosensitive drum) 101 in a developing region A. The present invention is particularly useful for a developing device of a system in which an electrostatic latent image is developed with the developer layer T1 as mentioned above, that is, a non-contact type developing device. In addition, the developer is charged mainly by frictional contact between the surface of the developer carrying member and the developer in the developer reservoir near the developer carrying member, involved in the rotation of the developer carrying member 102. Next, the developer thin layer surface on the developer carrying member 102 rotates toward the latent image-bearing member 101 in association with the rotation of the developer carrying member, and passes through the developing region A where the latent image-bearing member 101 and the developer carrying member 102 approach most closely. In the course of the passing, the developer in the developer thin layer on the surface side of the developer carrying member 102 flies by virtue of an electric field generated by a direct voltage and an alternating voltage applied between the latent image-bearing member 101 and the developer carrying member 102, and reciprocates between the surface of the latent image-bearing member 101 and the developer carrying member 102 surface (a gap $\alpha$) in the developing region A. Finally, the developer on the side of the developer carrying member 102 selectively transfers and adheres to the surface of the latent image-bearing member 101 in accordance with the electric potential pattern of the latent image on the surface, whereby a developer image T2 is sequentially formed.

The surface of the developer carrying member which has passed through the developing region A and the developer of which has been selectively consumed is supplied again with a developer by rotating again toward the developer reservoir in the developer container 106. The developer thin layer T1 surface on the developer carrying member 102 is conveyed toward the developing region A. Thus, the developing step is repeated. The developer image is transferred onto a transfer material via or not via an intermediate transfer member, then is fixed in a fixing step.

Figure 2:
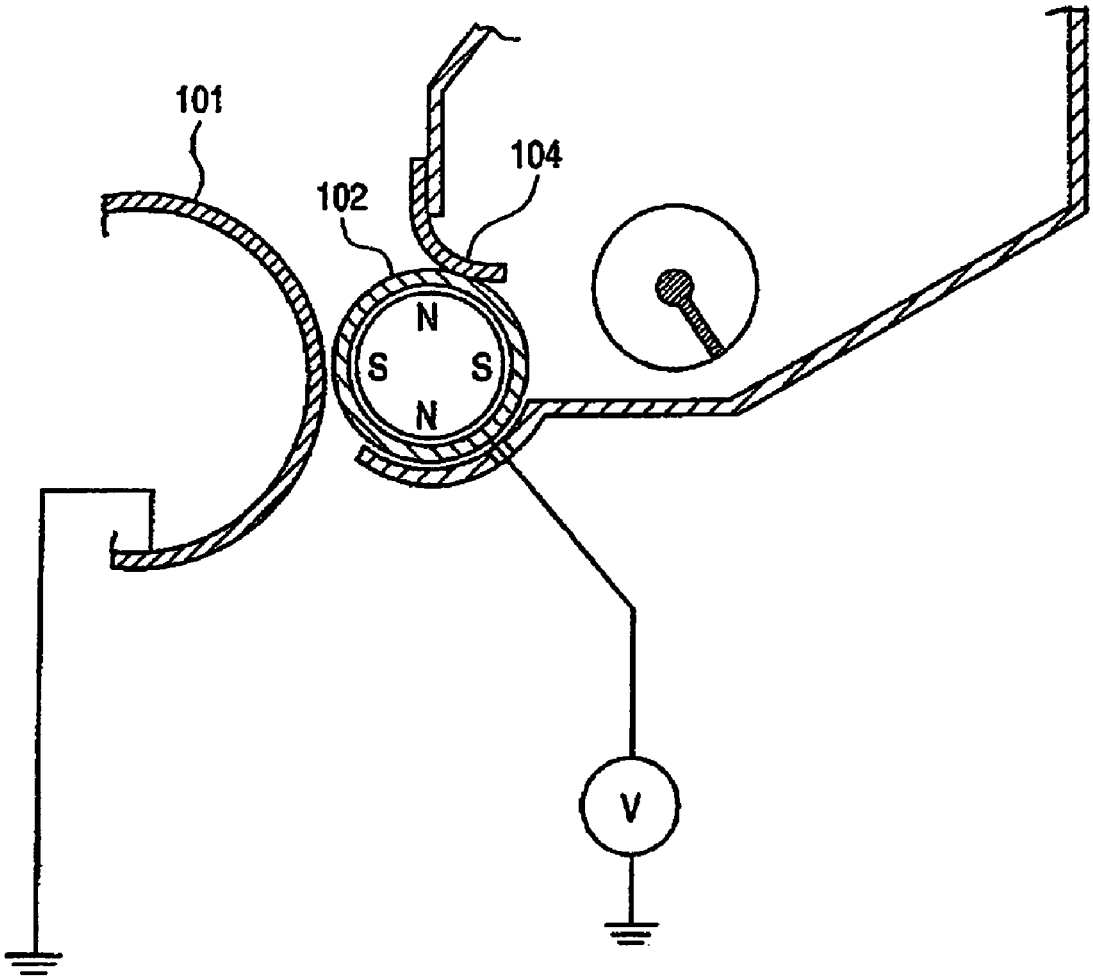
FIG. 2 is a schematic view showing an example of an image forming apparatus suitable for forming an image by means of the developer of the present invention.

In FIG. 1, a ferromagnetic metal hanged down so as to be opposite to the developer carrying member 102 is used as the regulating member 104. Alternatively, as shown in FIG. 2, a structure may be adopted in which the regulating member 104 is made of an elastic body and brought into contact with the developer carrying member 102.

In the image forming process, substantially the right semi-peripheral surface of the developer carrying member 102, that is, the developer reservoir in the developer container 106 is always stirred with a stirring member 105 for circulating the developer in the developer container 106, and the developer therein continues to receive some degree of shear. Furthermore, in the course of forming a thin layer of the developer on the developer carrying member 102, lines of magnetic force from the magnetic pole N1 concentrate on the regulating member 104, and the developer is packed. Since the thin layer is formed in such a state, the developer receives extremely large shear. In addition, aiming at high-speed printing and improved image quality is to increase the rotating speed of the developer carrying member 102 or to narrow the gap width between the regulating member 104 and the surface of the developer carrying member 102, hence the shear to be applied to the developer further increases.

As described above, the developer always receives large shear in the developer container. As a result, the developer is apt to deteriorate owing to, for example, the imbedding of an external additive due to increased shear in the developer container. When the developer deteriorates, a reduction in concentration is apt to occur in the latter half of running (or extensive operation) owing to a reduction in charge amount of the developer. Furthermore, in the course of forming a thin layer of the developer on the developer carrying member, the clusters of the developer formed on the developer carrying member become non-uniform owing to the shear to be applied when passing through the regulating member. Therefore, image quality tends to deteriorate, and fogging is apt to be remarkable. In addition, the deterioration of the developer is caused by the shear to be applied when passing through the regulating member, hence a reduction in concentration is apt to occur in the latter half of running.

Furthermore, in the course of carrying out development onto the photosensitive member as well, an excessive amount of developer is attracted to the electric potential pattern of a latent image in the developing region A owing to the non-uniform clusters formed on the developer carrying member as described above, hence image quality is apt to deteriorate. Furthermore, an excessive amount of developer is attracted to the electric potential pattern of a latent image, hence the consumption of the developer is apt to increase.

In view of the foregoing, it is extremely important to control the powder property of a developer layer in a consolidation state in the image forming process directed toward high-speed printing and improved image quality.

That is, the developer of the present invention is characterized in that: a unconfined yield strength at a major consolidation stress of 5.0 kPa of the developer is in the range of 0.1 to 2.5 kPa; and a unconfined yield strength at a major consolidation stress of 20.0 kPa of the developer is in the range of 2.5 to 5.5 kPa.

It is possible to discuss how easily a powder layer packed at an arbitrary load is disintegrated, that is, the powder property of a densely packed developer layer (cohesion between developer particles) on the basis of the relationship between a major consolidation stress (X) and a unconfined yield strength (U), which is characteristic of the present invention. The unconfined yield strength (U) is related to the easiness of disintegrating the layer by stirring in the developer container in the image forming process, and to the condition of the clusters of a developer formed on the developer carrying member when having passed through the regulating member while receiving shear from the regulating member. Furthermore, the major consolidation stress (X) in the present invention represents the stress applied to the densely packed developer by the shear which the developer receives in the developer container. Therefore, it is possible to discuss the powder property in a state in which the shear applied to the developer is relatively small on the basis of the unconfined yield strength at a major consolidation stress of 5.0 kPa and the powder property in a state in which the shear applied to the developer is relatively large on the basis of the unconfined yield strength at a major consolidation stress of 20.0 kPa. In addition, the powder property of a developer layer in a consolidation state in the image forming process was represented by evaluating the transition of the unconfined yield strength between the major consolidation stresses.

The present invention is characterized by the relationship at the major consolidation stress of 20.0 kPa or less. The major consolidation stress of 20.0 kPa is close to the upper limit that allows the powder to be present in the powder state. When the stress equal to or larger than 20.0 kPa is applied, the developer tends to be completely packed or consolidated. Therefore, it is preferable to discuss the powder property of the developer at the major consolidation stress of 20.0 kPa or less.

In the case where the unconfined yield strengths at the major consolidation stresses of 5.0 kPa and 20.0 kPa of the developer satisfy the ranges specified in the present invention, even when the developer receives shear in a developing unit, the developer can turn aside the shear, hence the deterioration of the developer is suppressed. Therefore, a stable image density can be obtained without deterioration in the developer even when printing speed is increased. When the developer layer in a consolidation state passes through the regulating member to form magnetic clusters, the developer that has received shear passes through the regulating member while being appropriately disintegrated, hence uniform clusters can be stably formed. As a result, a minimum required amount of developer can be attracted to the electric potential pattern of a latent image in the developing region A, so that image quality can be improved and the consumption of the developer can be reduced during the period from the initial stage of printing to the latter half of running.

On the other hand, a developer having a unconfined yield strength of more than 2.5 kPa at a major consolidation stress of 5.0 kPa or a unconfined yield strength of more than 5.5 kPa at a major consolidation stress of 20.0 kPa is one that is difficult to disintegrate in a consolidation state, that is, a developer in which cohesion between particles is large.

When such a developer is used, the inconvenience as described above occurs in the image forming process as described above.

In addition, a developer having a unconfined yield strength of 0.1 to 2.5 kPa at a major consolidation stress of 5.0 kPa and a unconfined yield strength of less than 2.5 kPa at a major consolidation stress of 20.0 kPa is one in which the cohesion between particles is extremely small. When such developer is used, no shear is applied to the developer in the developing unit, but the frictional force between the surface of the developer carrying member and the developer becomes so small that a charge amount generated by friction cannot be sufficiently obtained. Therefore, developability deteriorates and image quality is lowered. In addition, when such developer is used, the cohesiveness between particles is so small that the ejection of the developer from the inside of the developing unit becomes remarkable when the rotating speed of the developer carrying member is increased for high-speed printing.

In addition, when such developer is used, the developer becomes bulky, hence the loading weight of the developer in the developer container is reduced and the number of sheets per volume of the developer container on which printing can be performed decreases. This phenomenon is not preferable in terms of reduction in size of a developing unit.

As described above, by controlling the indication for the cohesiveness between particles in the consolidation state of a developer to fall within the range represented by the above relational expression the developer can be provided satisfying high durability, high reliability, and high image quality without deteriorating even in long-term use.

Here, the obtained major consolidation stress (X) and unconfined yield strength (U) were measured by means of a shear scan TS-12 (manufactured by Sci-Tec), and the shear scan performs measurement on the basis of the principle according to a Mohr-Coulomb model described in 'CHARACTERIZING POWDER FLOWABILITY' (published on Jan. 24, 2002) written by Prof. Virendra M. Puri.

Specifically, measurement is performed in a room-temperature environment (23° C., 60% RH) by means of a linear shearing cell (cylindrical shape, diameter 80 mm, volume 140 $cm^3$) to which shear force can be linearly applied in a sectional direction. A developer is charged into the cell, and a normal load of 2.5 kPa is applied to the cell. A consolidated powder layer is produced to have a closest packed state at this normal load (Measurement by means of the shear scan is preferable in the present invention because this consolidation state can be automatically detected with a pressure and can be produced with no individual difference.). Similarly, consolidated powder layers are formed at normal loads of 5.0 kPa and 10.0 kPa. Then, shear force is gradually applied to a sample formed at each of the normal loads while the normal load applied for forming the consolidated powder layer is continuously applied, and a test for measuring a fluctuation in shear stress at that time is performed to determine a steady state. The judgment that the consolidated powder layer has reached the steady state is performed as follows. When a variation in shear stress and displacement in the vertical direction of a load applying means for applying a normal load become small and both of them have stable values in the above test, the consolidated powder layer is judged to reach the steady state. Next, the normal load is gradually removed from the consolidated powder layer that has reached the steady state, a failure envelope at each load (normal load stress plotted versus shear stress) is created, and a Y-intercept and a gradient are determined. In the analysis by means of the Mohr-Coulomb model, the unconfined yield strength and the major consolidation stress are represented by the following expressions, and the Y-intercept represents "cohesion" while the gradient represents an "internal frictional angle".

Unconfined yield strength$=2c(1+\sin\phi)/\cos\phi$Major consolidation stress$=((A-(A^2\sin^2\phi-\tau_{ssp}{}^2\cos^2\phi)^{0.5})/\cos^2\phi)\times(1+\sin\phi)-(c/\tan\phi)$ $(A=\sigma_{ssp}+(c/\tan\phi))$, c=cohesion, $\phi$=internal frictional angle, $\tau_{ssp}=c+\sigma_{ssp}\times\tan\phi$, $\sigma_{ssp}$=normal load at steady state).

The unconfined yield strength and major consolidation stress calculated at each load are plotted (Flow Function Plot), and a straight line is drawn on the basis of the plot. The major consolidation stresses at the unconfined yield strengths of 5.0 kPa and 20.0 kPa are determined from the straight line.

In the present invention, it is important to control the unconfined yield strength at the major consolidation stress of 5.0 kPa of the developer to be 0.1 kPa to 1.5 kPa and the unconfined yield strength at the major consolidation stress of 20.0 kPa to be 2.5 kPa to 5.5 kPa. A measure for controlling them is not limited. For example, the major consolidation stress and the unconfined yield strength can be controlled as follows.

The inventors of the present invention have conducted researches on constituent materials to be used for toner. As a result, they have found that the relationship between the major consolidation stress (X) and unconfined yield strength (U) of a positively chargeable developer in a consolidation state can be controlled by, for example, externally adding an appropriate additive to toner particles having at least a binder resin and magnetic iron oxide.

Specifically, an inorganic fine powder having a zeta potential lower or higher than that of positively chargeable toner particles at the pH of a dispersion liquid prepared by dispersing the positively chargeable toner particles into water by 40 mV or less is preferably added as an external additive. The term "zeta potential of positively chargeable toner particles at the pH of a dispersion liquid prepared by dispersing the positively chargeable toner particles into water" represents the surface charge density of the powder of the toner particles at that pH. Therefore, the use of an inorganic fine powder having a zeta potential lower or higher than that of positively chargeable toner particles by 40 mV or less means the use of an inorganic fine powder having a surface charge density substantially equal to that of the surface of the toner particle. In general, when an inorganic fine powder is added to a toner particle, intermolecular force such as van der Waals force, electrostatic attraction, or liquid cross-linking force, is known to occur. By controlling the surface charge densities of the toner particles and the inorganic fine powder under the influence of such attraction force to be equal to each other, repulsive force can be exerted in the direction of alleviating the attraction force acting between the toner particles and the inorganic fine powder, whereby the cohesion between developer particles can be reduced. Therefore, the unconfined yield strength of the developer at the major consolidation stress of 5.0 kPa and the unconfined yield strength of the developer at the major consolidation stress of 20.0 kPa, which are characteristic of the present invention, can be easily controlled to fall within the range of 0.1 to 2.5 kPa and the range of 2.5 to 5.5 kPa, respectively.

When the difference in zeta potential between positively chargeable toner particles and an inorganic fine powder is larger than 40 mV, no action for alleviating the above-described attraction force occurs, hence the cohesion between the particles increases. Therefore, the developer deteriorates owing to, for example, the imbedding of an external additive due to increased shear in the developer container. As a result, a reduction in concentration occurs in the latter half of running owing to a reduction in charge amount of the developer. Furthermore, in the course of forming a thin layer of the developer on the developer carrying member, the clusters of the developer formed on the developer carrying member becomes non-uniform owing to the shear applied when the developer passes through the regulating member. Therefore, image quality deteriorates, and fogging becomes remarkable. In addition, the deterioration of the developer is caused by the shear applied when the developer passes through the regulating member, so that a reduction in concentration occurs in the latter half of running.

Furthermore, in the course of carrying out development on the photosensitive member, an excessive amount of developer is attracted to the electric potential pattern of a latent image in the developing region A owing to the non-uniform clusters formed on the developer carrying member as described above, so that image quality deteriorates. Furthermore, an excessive amount of developer is attracted to the electric potential pattern of a latent image, so that the consumption of the developer increases.

A method for measuring the zeta potential used in the present invention will be described below.

The zeta potentials of toner particles and an inorganic fine powder are measured by means of an ultrasonic zeta potential measuring device DT-1200 (manufactured by Dispersion Technology, Inc.). Purified water is used as a dispersion liquid to prepare a 0.5-vol % aqueous solution of the toner particles or the inorganic fine powder. 0.4 mass % (with respect to the particle concentration) of a nonionic dispersant having no influence on zeta potential is added as required. Then, the mixture is dispersed for 3 minutes by means of an ultrasonic dispersing device, and then stirred while being defoamed for 10 minutes to prepare a dispersion liquid of the toner particles or the inorganic fine powder. The toner dispersion liquid is used to measure the zeta potential of the toner particles. At the same time, the pH of the dispersion liquid is measured. In measuring the zeta potential of the inorganic fine powder, at first, the inorganic fine powder dispersion liquid is titrated with a 1 mol/l aqueous solution of HCl or a 1 mol/l aqueous solution of KOH. Then, a 1-mol/l aqueous solution of HCl or a 1-mol/l aqueous solution of KOH necessary for adjusting the pH value of the dispersion liquid of the toner particles is added to the dispersion liquid of the inorganic fine powder to adjust the pH of the dispersion liquid to be equal to that of the dispersion liquid of the toner particles. Thereafter, the zeta potential is measured by means of the above device.

At least one oxide selected from zinc oxide, alumina, and magnesium oxide is preferably used as the inorganic fine powder because the difference in surface charge density between the positively chargeable toner particles and the inorganic fine powder can be easily controlled to be small, so that the effect of alleviating the cohesion between the toner particles on the surface of each of the positively chargeable toner particles can be effectively exerted.

Of those, a magnesium oxide fine powder is more preferable, and magnesium oxide crystals in which other metals are less and crystal lattice defects are less (i.e., a magnesium oxide fine powder with high purity) are particularly preferably used for effectively exerting the effect of alleviating the cohesion. The purity of the magnesium oxide fine powder can be estimated by means of the half width of the X-ray diffraction peak of the magnesium oxide fine powder.

It is preferable that the magnesium oxide fine powder have a characteristic peak ascribable to the (200) crystal plane of the magnesium oxide crystal at a Bragg angle ($2\theta \pm 0.2$ deg) of 42.9 deg in X-ray diffraction using a CuK$\alpha$ ray, and the half width of the X-ray diffraction peak at the Bragg angle ($2\theta \pm 0.2$ deg) of 42.9 deg is 0.40 deg or less. That the half width of the X-ray diffraction peak is 0.40 deg or less means that the crystallinity of magnesium oxide is high, that is, other metals and lattice defects are less and the magnesium oxide crystal has high unity and high purity.

That the X-ray peak half width is larger than 0.40 deg means that crystallinity is bad, that is, the purity of the magnesium oxide crystal is low. In other words, the crystal lattice is distorted by the presence of other metals or crystal lattice defects, and the X-ray diffraction peak becomes broad. In the case of such magnesium oxide fine powder, charges are apt to leak due to other metals, hence the effect of alleviating electrostatic cohesion in the present invention cannot be sufficiently attained. In addition, water resistance weakens due to the crystal lattice defect, and hydration is caused by moisture absorption, so that the above alleviating effect cannot be obtained. At the same time, it becomes difficult to control physical properties. For example, the shape of the crystal is apt to be non-uniform, and the particle size distribution becomes broad.

The X-ray diffraction measurement in the present invention is performed by using a CuK$\alpha$ ray under the following conditions.

[Sample Preparation]

1) 200 ml of methanol per 3 g of a developer is added in a 500-ml beaker.

2) The resultant is dispersed with an ultrasonic wave for 3 minutes to liberate an external additive.
3) A magnet is brought into contact with the rear surface of the beaker, and a methanol supernatant containing the liberated external additive is separated in a state in which magnetic toner particles are captured.
4) After the supernatant has been separated, 200 ml of methanol are added again to the magnetic toner particles in the beaker, and the operations 2) and 3) are repeated three times.
5) The separated methanol supernatant is subjected to vacuum filtration by means of a membrane filter having an aperture of 2 μm to collect a solid content, thereby obtaining an external additive sample.

[Conditions for X-Ray Diffraction Measurement]

Measuring device used: Sample horizontal strong X-ray diffracting device (RINT TTRII) manufactured by Rigaku Corporation.
Tube Bulb: Cu
Parallel beam optical system
Voltage: 50 kV
Current: 300 mA
Starting angle: 30°
Ending angle: 50°
Sampling width: 0.02°
Scan speed: 4.00°/min
Divergence slit: Open
Divergence vertical slit: 10 mm
Scattering slit: Open
Light-receiving slit: 1.0 mm The attribution and half width of the resultant X-ray diffraction peak are calculated by means of analysis software "JADE 6" manufactured by Rigaku Corporation.

The above magnesium oxide fine powder particularly exerts an effect when the acid value of the developer is 0.5 to 20.0 mgKOH/g, preferably 1.0 to 10.0 mgKOH/g, or particularly preferably 3.0 to 7.0 mgKOH/g.

By controlling the acid value of the developer to fall within the range, the affinity between carboxyl groups on the positively chargeable toner particle surfaces and the magnesium oxide fine powder surfaces is improved, and the magnesium oxide fine powder can be surely caused to be present on the surface of the toner particle. As a result, the liberation ratio of the magnesium oxide fine powder from the toner particle can be controlled to fall within an optimum range, so that the effect alleviating the cohesion between the developers is most effectively induced. Furthermore, controlling the acid value to fall within the range can uniformize the positive chargeability of the toner particle surface. As a result, the positive chargeability of the surface of the developer is also uniformized, and the cohesiveness between the developers can be additionally alleviated. Thus, a high-definition image can be obtained stably for a long time period.

When the acid value of the developer is less than 0.5 mgKOH/g, the affinity between the toner particle surface and the magnesium oxide fine powder decreases, so that the of the magnesium oxide fine powder tends to come off from the toner particle surface. As a result, no effect of alleviating the cohesion between developers can be obtained. In addition, when the acid value exceeds 20.0 mgKOH/g, the affinity between the toner particle surface and the magnesium oxide fine powder is so large that no effect of alleviating the cohesion between developers can be obtained. Furthermore, when the acid value exceeds 20.0 mgKOH/g, if the developer is applied to a positively chargeable developer, the negative chargeability of a binder resin in a toner particle may increase, image density may be reduced, and fogging may increase.

When such magnesium oxide fine powder as described above is used, image quality with no tailing independent of an environment can be stably obtained for a long time period even in a high-speed developing system. Furthermore, a reduction in concentration, fogging, and the like hardly occur.

In addition, the magnesium oxide fine powder has a volume average particle size (Dv) of preferably 0.1 to 2.0 μm, more preferably 0.9 to 2.0 μm, or still more preferably 1.0 to 1.5 μm. In addition, the volume distribution cumulative value of the magnesium oxide fine powder having a particle size equal to or smaller than one half the volume average particle size is preferably 10.0 vol % or less, or more preferably 7.0 vol % or less. In addition, the volume distribution cumulative value of the magnesium oxide fine powder having a particle size equal to or larger than twice the volume average particle size is preferably 10.0 vol % or less, or more preferably 7.0% or less. A magnesium oxide fine powder having a volume average particle size of less than 0.1 μm is disadvantageous in terms of the impartment of flowability to a toner particle, with the result that the cohesiveness between developer particles increases and the concentration reduces in the latter half of running. A volume average particle size of 2.0 μm or more is not preferable because the particle size of the magnesium oxide fine powder is so large that the fine powder is apt to be liberated from a toner particle and hence the effect of alleviating cohesiveness cannot be sufficiently obtained. Furthermore, when the volume distribution cumulative value of the magnesium oxide fine powder having a particle size equal to or smaller than one half the volume average particle size is 10 vol % or more, or the volume distribution cumulative value of the magnesium oxide fine powder having a particle size equal to or larger than twice the volume average particle size is 10 vol % or more, particle size distribution becomes broad, and the above detrimental effects are apt to occur, hence the effect alleviating the cohesiveness of the developer cannot be sufficiently obtained.

A general classifying device can be used without any limitations as a means for achieving the particle size distribution in which the volume average particle size of the magnesium oxide fine powder is 0.1 to 2.0 μm, the volume distribution cumulative value of the magnesium oxide fine powder having a particle size equal to or smaller than one half the volume average particle size is 10 vol % or less, and the volume distribution cumulative value of the magnesium oxide fine powder having a particle size equal to or larger than twice the volume average particle size is 10.0 vol % or less.

A laser diffraction/scattering particle size distribution measuring device LA-920 (manufactured by HORIBA) is used as a measuring device for the particle size distribution of the magnesium oxide fine powder in the developer of the present invention. A measurement method includes: placing several milligrams of a sample into 200 ml of ion-exchange water to serve as a dispersion liquid in such a manner that a sample concentration is around 80% in terms of transmittance; dispersing the dispersion liquid for 1 minute by means of an ultrasonic dispersing device; and measuring the volume-based particle size distribution of the magnesium oxide fine powder by means of the above measuring device with the relative refractive index of the magnesium oxide fine powder with respect to water set to be 1.32 to determine the volume average particle size of the magnesium oxide fine powder, the volume distribution cumulative value of the magnesium oxide fine powder having a particle size equal to or smaller than one half the volume average particle size, and the volume distribution cumulative value of the magnesium oxide fine powder having a particle size equal to or larger than twice the volume average particle size.

In addition, the magnesium oxide fine powder in the developer of the present invention has an isoelectric point of preferably 8 to 14, more preferably 9 to 14, or particularly preferably 12 to 14. When the isoelectric point of the magnesium oxide fine powder is less than 8, the positive chargeability of the magnesium oxide fine powder reduces, hence the effect of alleviating the cohesiveness reduces. In addition, since the chargeability of the developer becomes non-uniform, fogging is apt to occur.

The isoelectric point of the magnesium oxide fine powder is determined from the zeta potential. In the present invention, the zeta potential of the magnesium oxide fine powder is measured by means of an ultrasonic zeta potential measuring device DT-1200 (manufactured by Dispersion Technology, Inc.). Purified water is used as a dispersion liquid to prepare a 0.5-Vol % aqueous solution of the magnesium oxide fine powder. Then, the mixture is dispersed for 3 minutes by means of an ultrasonic dispersing device (VCX-750 manufactured by Sonic & Materials), and then the resultant is stirred while being defoamed for about 10 minutes to prepare a dispersion liquid. A graph showing a change in zeta potential of the dispersion liquid with pH is drawn by means of the above device, and an isoelectric point is calculated from the graph. The term "isoelectric point" refers to the pH value at which the zeta potential becomes zero.

The specific surface area of the magnesium oxide fine powder used in the present invention is preferably 1.0 to 15.0 $m^2/g$.

When the specific surface area is larger than 15.0 $m^2/g$, the magnesium oxide fine powder is apt to be embedded in a toner particle. That is, the developer is apt to deteriorate. Furthermore, the rate of moisture absorption increases in a high-humidity environment, charges are reduced, and the concentration is reduced in the latter half of running. When the specific surface area is smaller than 1.0 $m^2/g$, sufficient flowability cannot be imparted to the developer, with the result that a problem such as low concentration occurs.

A method of measuring a BET specific surface area is as follows, The surface of a sample is allowed to adsorb a nitrogen gas by means of a specific surface area measuring device GEMINI 2375 (Shimadzu Corporation) in accordance with a BET specific surface area method, and a specific surface area is calculated by means of a BET specific surface area multipoint method.

The MgO content in the particles of the magnetic oxide fine powder used in the present invention is preferably 98.00% or more, or more preferably 99.90% or more. The MgO content of less than 98.00%, that is, the low purity of MgO is not preferable because the effect of alleviating the cohesion generated by the magnesium oxide fine powder cannot be sufficiently obtained.

The liberation ratio of an inorganic fine powder is in the range of preferably 0.1 to 5.0%, more preferably 2.0 to 4.0%, or particularly preferably 2.5 to 3.5% in order that the cohesion between particles may be effectively alleviated and the inorganic fine powder may be uniformly present on the toner particle surface. A liberation ratio in excess of 5.0% is not preferable because the developer cannot obtain appropriate chargeability. Furthermore, the amount of the inorganic fine powder present near the toner particle surface reduces, hence the effect of alleviating the cohesion between particles reduces.

The liberation ratio can be controlled to fall within an appropriate range by adjusting conditions for external addition in a conventionally known method for external addition. A HENSCHEL mixer, a homogenizer, or the like can be preferably used as a stirring device, and a HENSCHEL mixer can be more preferably used. The liberation ratio of the inorganic fine powder must be controlled by adjusting external addition strength while controlling the number of revolutions, the angle of a baffle plate, and stirring time, and sufficiently taking an interaction of the inorganic fine powder with any other external additives into consideration.

In the present invention, the liberation ratio of the inorganic fine powder from a toner particle is measured by means of a particle analyzer (PT1000: manufactured by Yokokawa Electric Corporation). The particle analyzer is a device capable of determining the elements, number of particles, and particle size of a light-emitting material from the emission spectra of fine particles of toner and the like by introducing the fine particles one by one into plasma. The measurement is performed on the basis of the principle described in the collection of Japan Hardcopy 97, p. 65 to 68. Specifically, a toner sample that has been subjected to moisture conditioning by being left standing overnight in an environment having a temperature of 23° C. and a humidity of 60% is subjected to measurement in the environment by means of a helium gas containing 0.1% of oxygen. That is, a channel 1 is used for the measurement of a carbon atom (measuring wavelength 247.86 nm) and a channel 3 is used for the measurement of an aluminum atom (measuring wavelength 396.15 nm). Sampling is performed in such a manner that the number of emissions of the carbon atom is 1,000 to 1,400 by one scan. Scan is repeated until the total number of emissions of the carbon atom is 10,000 or more, and the number of emissions is integrated. Then, the number of emissions of only the aluminum atom at that time is counted and defined as the number of liberated alumina. A noise cut level at this time is set to be 1.50 V. Next, how to think about the liberation ratio will be described. For example, the case where a toner particle added with alumina as an inorganic fine powder is introduced into plasma is taken into consideration. When the particle is introduced into the plasma, the emission of carbon as a constituent element of a binder resin and the emission of an aluminum atom derived from alumina are observed. At that time, an aluminum atom that has emitted light within 2.6 msec from the emission of a carbon atom is defined as an atom that has simultaneously emitted light, and the emission of an aluminum atom thereafter is defined as the emission of only an aluminum atom. The simultaneous emission of a carbon atom and an aluminum atom means that alumina adheres to a toner particle surface, while the emission of only an aluminum atom means that alumina is liberated from a toner particle.

Furthermore, the content of the inorganic fine powder is preferably 0.01 to 2.0 mass % on the basis of the entirety of the developer. When the content exceeds 2.0 mass %, the developer cannot obtain appropriate chargeability, with the result that an alleviating effect on the cohesion between particles reduces.

The inorganic fine powder may be subjected to a surface treatment with a conventionally known treatment agent before use.

The developer of the present invention is preferably added with an inorganic fine powder for alleviating the cohesiveness between particles. Furthermore, the developer is more preferably added with a silica fine powder for improving charging stability, developability, flowability, and durability. It has been also found that the inorganic fine powder can be uniformly dispersed into a toner particle surface by using a silica fine powder having a high ability to impart flowability to the toner particle surface and having a small number average particle size of primary particles in combination with the inorganic fine powder. When the inorganic fine powder is not uniformly dispersed, the effect of alleviating the cohesion between particles is unevenly realized, and the deterioration of the developer in high-speed printing is apt to be accelerated. As a result, a reduction in concentration occurs in the latter half of running owing to a reduction in charge amount of the developer. Furthermore, in the course of forming a thin layer of the developer on the developer carrying member, the clusters of the developer formed on the developer carrying member becomes non-uniform owing to the shear applied when the developer passes through the regulating member. Therefore, the image quality deteriorates, and the fogging becomes remarkable. In addition, the deterioration of the developer is caused by the shear applied when the developer passes through the regulating member, hence a reduction in concentration occurs in the latter half of running. The silica fine powder preferably has a BET specific surface area of 70 to 130 $m^2/g$.

Furthermore, when the inorganic fine powder is not uniformly dispersed, in the course of carrying development on the photosensitive member, an excessive amount of developer is attracted to the electric potential pattern of a latent image in the developing region A owing to the non-uniform clusters on the developer carrying member, hence image quality deteriorates. Furthermore, an excessive amount of developer is attracted to the electric potential pattern of a latent image, hence the consumption of the developer increases.

Each of so-called dry silica which is produced by vapor-phase oxidation of a silicon halide compound and is referred to as dry method or fumed silica and so-called wet silica produced from water glass or the like can be used as the silica fine powder. It should be noted that dry silica is preferable because it has the reduced number of silanol groups on the surface of a silica fine powder and in the powder and produces a reduced amount of production residue such as $Na_2O$ or $SO_3^-$. In addition, in the case of dry silica, a composite fine powder of a silica fine powder and any other metal oxide can be obtained by using a silicon halide compound in combination with, for example, a metal halide compound such as aluminum chloride or titanium chloride in a production step. Such composite fine powder is also included in the silica fine powder of the present invention.

The silica fine powder in the present invention is preferably subjected to hydrophobic treatment. Subjecting the silica fine powder to a hydrophobic treatment can prevent a reduction in chargeability of the silica fine powder in a high-humidity environment and improve the environmental stability of the frictional charge amount of a toner particle having a silica fine powder adhering to its surface. As a result, the environmental stability of the development properties of the developer such as an image density and fogging can be additionally improved. When the wettability of the silica fine powder in the present invention with respect to a mixed solvent of methanol and water is measured in terms of transmittance of light having a wavelength of 780 nm, a methanol concentration at a transmittance of 80% is preferably in the range of 65 to 80 vol %.

A methanol concentration at the transmittance of 80% in excess of 80 vol % is not preferable because the incorporated toner is apt to charge up. In addition, when a methanol concentration at a transmittance of 80% is less than 65 vol %, the toner is susceptible to water in the air, thus the toner cannot obtain good developability.

In the present invention, the relationship between the transmittance and the methanol concentration, that is, the wettability of the silica fine powder, that is, the hydrophobic property of the silica fine powder is measured by means of a methanol drop transmittance curve. Specifically, an example of a measuring device to be used for the measurement includes a powder wettability testing machine WET-100P manufactured by RHESCA COMPANY, LIMITED. A specific example of the measurement operation includes the following.

At first, 70 ml of a water-containing methanol solution composed of 60 vol % of methanol and 40 vol % of water are charged into a container, and dispersed for 5 minutes by means of an ultrasonic dispersing device for removing air bubbles and the like in the sample for measurement. 0.5 g of silica as a sample is precisely weighed and added to the container, thereby preparing a sample solution for measuring the hydrophobic property of a developer.

Next, methanol is continuously added at a dropping rate of 1.3 ml/min while the sample solution for measurement is stirred at a rate of 6.67 $s^{-1}$, and a transmittance is measured by means of light having a wavelength of 780 nm to create a methanol drop transmittance curve. In this measurement, the flask used is made of glass having a circular shape of 5 cm in diameter and a thickness of 1.75 mm, and the magnetic stirrer used is of a spindle shape having a length of 25 mm and a maximum diameter of 8 mm and is coated with a fluorine resin.

Treatment agents such as silicone varnishes, various modified silicone varnishes, unmodified silicone oils, various modified silicone oils, silane compounds, silane coupling agents, other organic silicon compounds, and organic titanium compounds may be used alone or in combination for hydrophobic treatment. Of those, the treatment is preferably performed by using a silane compound having a substituent with a nitrogen element (in particular, an amino group) or a silicone oil, from the viewpoint of chargeability.

It should be noted that a silane compound having an amino group greatly contributes to the impartment of positive chargeability to silica, and when a large amount of the compound is used for the treatment, strong positive chargeability is provided, but a hygroscopic property increase owing to the hydrophilicity of the amino group. Therefore, when a silane compound is used, the treatment is preferably performed by using the compound in combination with silicone oil. The treatment can be performed in accordance with a conventionally known method.

In order that a developer satisfying the relationship between the major consolidation stress and the unconfined yield strength in the present invention may be produced, a peak particle size X and a half width Y in the number-based particle size distribution of the developer measured with 256 channels by means of a Coulter Counter desirably satisfy the following relationship.

$$2.06 \times X - 9.0 \leqq Y \leqq 2.06 \times X - 7.5$$

The peak particle size X means the central value of a channel where a frequency becomes maximum, and the half width Y means the difference in central value between two channels including a frequency equal to one half the maximum frequency.

Where the peak particle size X and the half width Y in the number-based particle size distribution measured with 256 channels by means of a Coulter Counter satisfy the relationship of $Y > 2.06 \times X - 7.5$, it means that in the developer, the cumulative numbers of particle sizes other than the peak particle size X are larger than the cumulative number of the peak particle size X, that is, the developer has broad particle size distribution. In the case of such developer, the charge distribution of the developer may become uneven and the cohesiveness between particles may increase. As a result, the developer is apt to deteriorate owing to, for example, the imbedding of an external additive due to increased shear in the developer container, and a reduction in concentration is apt to occur after running. Furthermore, in the course of forming a thin layer of the developer on the developer carrying member, the clusters of the developer formed on the developer carrying member become non-uniform owing to the shear applied when the developer passes through the regulating member. Therefore, image quality tends to be lowered, and fogging tends to be remarkable. In addition, the developer is apt to deteriorate owing to the shear applied when the developer passes through the regulating member, hence a reduction in concentration is apt to occur after running.

Furthermore, an excessive amount of developer is attracted to the electric potential pattern of a latent image in the developing region A owing to the non-uniform clusters on the developer carrying member, hence image quality may be lowered. Furthermore, an excessive amount of developer is attracted to the electric potential pattern of a latent image, hence the consumption of the developer may increase. Where the peak particle size X and the half width Y in the number-based particle size distribution measured with 256 channels by means of a COULTER COUNTER satisfy the relationship of $Y<2.06\times X-9.0$, it means that the developer is very sharp in particle size distribution. A developer sharp in particle size distribution is reduced in the cohesiveness between particles because of its uniform charge. When such developer is used, the shear in the developing unit weakens, but the frictional force between the surface of the developer carrying member and the developer becomes so small that it becomes difficult to sufficiently obtain a charge amount generated by friction. Therefore, developability deteriorates and image quality is apt to be lowered. In addition, when such developer is used, the cohesiveness between particles is so small that the ejection of the developer from the inside of the developing unit is apt to occur when the rotating speed of the developer carrying member is increased for high-speed printing.

A developer sharp in particle size distribution can be produced by greatly cutting out a fine powder and a coarse powder in a classifying step. However, such a production method is not realistic because the yield of toner particles having a desired particle size distribution decreases.

Furthermore, the acid value of the developer of the present invention is preferably 0.5 to 20.0 mgKOH/g, more preferably 1.0 to 10.0 mgKOH/g, or particularly preferably 3.0 to 7.0 mgKOH/g. By controlling the acid value of the developer to fall within the range, the affinity between carboxyl groups on the positively chargeable toner particle surfaces and the inorganic fine powder surfaces is improved, so that the inorganic fine powder can be surely allowed to exist on the surface of the toner particle. As a result, repulsive force for alleviating the cohesion between developer particles can be efficiently exerted, and it becomes easier to disintegrate the developer in a consolidation state. When the acid value of the developer is less than 0.5 mgKOH/g, the affinity between the toner particle surface and the inorganic fine powder reduces, so that the inorganic fine powder is apt to fall off from the toner particle surface. As a result, the effect of alleviating the cohesion between particles reduces, and the easiness of disintegrating the developer in a consolidation state is lowered. In addition, when the acid value exceeds 20.0 mgKOH/g, the affinity between the toner particle surface and the inorganic fine powder is so large that the effect of alleviating the cohesion between particles is reduced. Furthermore, when the acid value exceeds 20.0 mgKOH/g, if the developer is applied to positively chargeable toner, the negative chargeability of a binder resin in a toner particle may increase, image density may be reduced, and fogging may increase.

In addition, the amount of tetrahydrofuran (THF) insoluble matter of the binder resin component resulting from Soxhlet extraction of the developer of the present invention for 16 hours is preferably 0.1 to 50.0 mass %, more preferably 10.0 to 50.0 mass %, or still more preferably 20.0 to 50.0 mass %.

The THF insoluble matter serves to maintain the durability of the developer, and plays an important role in preventing the deterioration of the developer (such as the imbedding of an external additive) when applied to a high-speed machine. Furthermore, the THF insoluble matter is a component effective in exerting good releasability from a heating member such as a fixing roller, and exhibits an effect of reducing the offset amount of the developer with respect to the heating member such as a fixing roller when applied to a high-speed machine. When the amount of the THF insoluble matter exceeds 50.0 mass %, fixability may deteriorate, the dispersibility of a raw material in the developer may deteriorate, and chargeability may become non-uniform, increasing the cohesion between developer particles.

It is desirable that the developer of the present invention has a main peak in a molecular weight region of 3,000 to 30,000 in the molecular weight distribution of THF soluble matter measured by means of GPC, and a peak area of a molecular weight region of 100,000 or less accounts for 70 to 100 mass % of the entire peak area.

The presence of the main peak in a molecular weight region of 3,000 to 30,000 provides a raw material in the developer with good dispersibility. As a result, chargeability becomes uniform and the cohesion between developer particles is alleviated. Furthermore, the presence of the main peak in a molecular weight region of 3,000 to 30,000 can achieve good low-temperature fixability and good blocking resistance. Furthermore, the developer does not deteriorate because it is excellent in durability upon high-speed printing. When the main peak is present in a molecular weight region of less than 3,000, blocking resistance is lowered, and the developer deteriorates upon high-speed printing to reduce image density and lower image quality. When the main peak is present in a molecular weight region in excess of 30,000, sufficient fixability cannot be obtained. Furthermore, the dispersibility of a raw material deteriorates when producing toner particles, and charges become non-uniform to increase the cohesion between developer particles. In addition, sufficient fixability cannot be achieved when a peak area of a molecular weight region of 100,000 or less accounts for less than 70% of the entire peak area.

Examples of kinds of binder resin of the present invention include a styrene-type homopolymerization resin, a styrene-type copolymerization resin, a polyester resin, a polyol resin, a polyvinyl chloride resin, a phenolic resin, a natural denatured phenolic resin, a natural resin denatured maleic resin, an acrylic resin, a methacrylic resin, polyvinyl acetate, a silicone resin, a polyurethane resin, a polyamide resin, a furan resin, an epoxy resin, a xylene resin, a polyvinyl butyral, a terpene resin, a coumarone-indene resin, and a petroleum-type resin.

The binder resin of the present invention is preferably a styrene-type copolymerization resin taking into account the fact that it can be used for positively charged toner particles and its affinity with inorganic fine powder can be easily controlled. Further, a styrene-type copolymerization resin may be a mixture or reaction product of a carboxyl group-containing resin and a glycidyl group-containing resin.

Examples of a comonomer for a styrene monomer of styrene-type copolymerization resin include: styrene derivatives such as vinyltoluene; acrylic acid; acrylates such as methyl acrylate, ethyl acrylate, butyl acrylate, dodecyl acrylate, octyl acrylate, 2-ethylhexyl acrylate, and phenyl acrylate; methacrylic acid; methacrylates such as methyl methacrylate, ethyl methacrylate, butyl methacrylate, and octyl methacrylate; maleic acid; dicarboxylates having a double bond such as butyl maleate, methyl maleate, and dimethyl maleate; acrylamide; acrylonitrile; methacrylonitrile; butadiene; vinyl chloride; vinyl esters such as vinyl acetate and vinyl benzoate; ethylene-type olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether. These vinyl-type monomers are used alone or in combination.

The binder resin in the present invention is a resin having an acid value in the range of preferably 0.5 to 20.0 mgKOH/g or particularly preferably 0.5 to 15.0 mgKOH/g. When the acid value exceeds 20.0 mgKOH/g, if the binder resin is applied to positively chargeable toner, the negative chargeability of the binder resin in a toner particle increases. When the acid value is less than 0.5 mgKOH/g, the affinity between the toner particle surface and the inorganic fine powder is reduced, hence the inorganic fine powder tends to come off from the toner particle surface. As a result, the effect of alleviating the cohesion between particles decreases, and the easiness of disintegrating the developer in a consolidation state deteriorates.

Examples of a monomer controlling the acid value of the binder resin include: acrylic acid such as acrylic acid, methacrylic acid, α-ethyl acrylate, crotonic acid, cinnamic acid, vinyl acetate, isocrotonic acid, or angelic acid and an α- or β-alkyl derivative thereof; and an unsaturated dicarboxylic acid such as fumalic acid, maleic acid, citraconic acid, alkenyl succinic acid, itaconic acid, mesaconic acid, dimethyl maleic acid, or dimethyl fumalic acid and a monoester or anhydride thereof. Of those, a monoester derivative of an unsaturated dicarboxylic acid is particularly preferably used to control the acid value.

Particularly preferred examples of a compound include: monoesters of α- or β-unsaturated dicarboxylic acid such as monomethyl maleate, monoethyl maleate, mono n-butyl maleate, mono n-octyl maleate, monoallyl maleate, monophenyl maleate, monomethyl fumarate, monoethyl fumarate, mono n-butyl fumarate, and monophenyl fumarate; and monoesters of alkenyl dicarboxylic acid such as mono n-butyl n-butenylsuccinate, monomethyl n-octenylsuccinate, monoethyl n-butenylmalonate, monomethyl n-dodecenylglutarate, and mono n-butyl n-butenyladipate.

The carboxyl group-containing monomer as described above may be added at 0.1 to 20.0 parts by mass, or preferably 0.2 to 15.0 parts by mass with respect to 100 parts by mass of the total monomers consisting of the binder resin.

Examples of a method of synthesizing the binder resin include a solution polymerization method, an emulsion polymerization method, and a suspension polymerization method.

Of those, the emulsion polymerization method involves: dispersing a monomer hardly soluble in water as small particles into an aqueous phase by means of an emulsifier; and performing polymerization by means of a water-soluble polymerization initiator. This method is advantageous for producing a binder resin for toner because of, for example, the following reasons. Heat of reaction can be easily adjusted. In addition, a phase in which polymerization is performed (an oil phase composed of a polymer and a monomer) and the aqueous phase are separated from each other, so the rate of a termination reaction is small. As a result, a rate of polymerization is large, and a polymer with a high polymerization degree can be obtained. Furthermore, the polymerization process is relatively easy, and a polymerization product is a fine particle, so that a colorant, a charge control agent, and any other additive can be easily mixed in toner production.

However, since the produced polymer is apt to be impure owing to the added emulsifier, an operation such as salting out is required for taking out the polymer. Suspension polymerization is convenient for avoiding this inconvenience.

Suspension polymerization is desirably performed by using 100 parts by mass or less (preferably 10 to 90 parts by mass) of a monomer with respect to 100 parts by mass of an aqueous solvent. Examples of a usable dispersant include polyvinyl alcohol, a partially saponified product of polyvinyl alcohol, and calcium phosphate. In general, such a dispersant is used in an amount of 0.05 to 1 part by mass with respect to 100 parts by mass of an aqueous solvent. A polymerization temperature, which is appropriately 50 to 95° C., is appropriately selected depending on an initiator to be used and a target polymer.

The binder resin used in the present invention is preferably synthesized by using any one of such polyfunctional polymerization initiators as exemplified below.

Specific examples of the polyfunctional polymerization initiator having a polyfunctional structure are one selected from: polyfunctional polymerization initiators containing in one molecule two or more functional groups each having a polymerization initiating function such as a peroxide group (for example, 1,1-di-t-butylperoxy-3,3,5-trimethylcyclohexane, 1,3-bis-(t-butylperoxyisopropyl)benzene, 2,5-dimethyl-2,5-(t-butylperoxy)hexane, 2,5-dimethyl-2,5-di-(t-butylperoxy)hexane, tris-(t-butylperoxy)triazine, 1,1-di-t-butylperoxycyclohexane, 2,2-di-t-butylperoxybutane, 4,4-di-t-butylperoxyvaleric acid-n-butylester, di-t-butylperoxyhexahydroterephthalate, di-t-butylperoxy azelate, di-t-butylperoxytrimethyladipate, 2,2-bis-(4,4-di-t-butylperoxycyclohexyl)propane, 2,2-t-butylperoxyoctane, and various polymer oxides); and polyfunctional polymerization initiators containing in one molecule both of a functional group having a polymerization initiating function such as a peroxide group and a polymerizable unsaturated group (for example, diallylperoxy dicarbonate, t-butylperoxy maleic acid, t-butylperoxyallyl carbonate, and t-butylperoxyisopropyl fumarate).

Of those, the polyfunctional polymerization initiator is more preferably 1,1-di-t-butylperoxy-3,3,5-trimethylcyclohexane, 1,1-di-t-butylperoxycyclohexane, di-t-butylperoxyhexahydroterephthalate, di-t-butylperoxy azelate, 2,2-bis-(4,4-di-t-butylperoxycyclohexyl)propane, or t-butylperoxyallyl carbonate.

Such functional polymerization initiator is preferably used in combination with a monofunctional polymerization initiator in order to satisfy various kinds of performance required as a binder resin, is particularly preferably used in combination with a polymerization initiator of which half-life 10-hour temperature is lower than that of the polyfunctional polymerization initiator.

Specific examples of the functional polymerization initiator include: organic peroxides such as benzoyl peroxide, 1,1-di(t-butylperoxy)-3,3,5-trimethylcyclohexane, n-butyl-4,4-di(t-butylperoxy) valerate, dicumyl peroxide, α,α'-bis(t-butylperoxydiisopropyl)benzene, t-butylperoxycumene, and di-t-butyl peroxide; and azo and diazo compounds such as azobisisobutyronitrile and diazoaminoazobenzene.

Each of those monofunctional polymerization initiators may be added to a monomer simultaneously with addition of the polyfunctional polymerization initiator. However, in order to keep the efficiency of the polyfunctional polymerization initiator optimal, the monofunctional polymerization initiator is preferably added after the half-life of the polyfunctional polymerization initiator passes in the polymerization step.

The polymerization initiator is preferably used in an amount of 0.05 to 2 parts by mass with respect to the 100 parts by mass of a monomer in terms of efficiency.

The binder resin is preferably cross-linked by a cross-linkable monomer.

As the usable cross-linkable monomer, a monomer having two or more polymerizable double bonds is primarily used. Specific examples thereof include a aromatic divinyl compound (for example, divinyl benzene or divinyl naphthalene); acrylate compounds bonded with an alkyl chain (for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds in which acrylate in the above compounds is replaced with methacrylate); diacrylate compounds bonded with an alkyl chain including an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds in which acrylate in the above compounds is replaced with methacrylate); diacrylate compounds bonded with a chain including an aromatic group and an ether bond (for example, polyoxyethylene (2)-2,2-bis(4-hydroxyphenyl) propane diacrylate, polyoxyethylene (4)-2,2-bis(4-hydroxyphenyl) propane diacrylate, and compounds in which acrylate in the above compounds is replaced with methacrylate); and polyester diacrylate compounds (for example, trade name: MANDA (Nippon Kayaku Co., Ltd)). Examples of a polyfunctional cross-linking agent include: pentaerythritol acrylate, trimethylolethane triacrylate, trimethylolpropane triacrylate, tetramethylolpropane triacrylate, tetramethylolmethane tetraacrylate, origoester acrylate, and compounds in which acrylate in the above compounds is replaced with methacrylate; and triallyl cyanurate and triallyl trimellitate.

Such cross-linking agent is used in an amount in the range of preferably 0.00001 to 1 part by mass, or more preferably 0.001 to 0.05 part by mass with respect to 100 parts by mass of other monomer components.

Of those cross-linkable monomers, diacrylate compounds bound with a chain including an aromatic divinyl compound (especially divinylbenzene), an aromatic group, and an ether bond are examples of those preferably used in terms of the fixability and offset resistance of toner.

Other available methods of synthesizing the binder resin can include a bulk polymerization method and a solution polymerization method. The bulk polymerization method can provide a low-molecular-weight polymer as a result of performing polymerization at a high temperature to increase the termination reaction rate, but has such a problem that the reaction is difficult to control. In contrast, the solution polymerization method is preferable because a desired low-molecular-weight polymer can be easily obtained under moderate conditions by adjusting the amount of an initiator and a reaction temperature with the aid of the difference in chain transfer between radicals due to a solvent. In particular, a solution polymerization method under a pressurized condition is also preferable because the amount of an initiator to be used can be minimized and an influence of a remaining initiator can be suppressed to the utmost.

When a polyester resin is used as the binder resin, such acid components and alcohol components as described below can be used as monomers.

Examples of a dihydric alcohol component include: ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; hydrogenated bisphenol A; and a bisphenol represented by a formula (E) and a derivative thereof; and diols each represented by a formula (F).

(E)

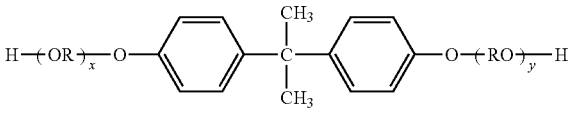

(In the formula, R represents an ethylene or propylene group, x and y each represent an integer of 0 or more, and the average of x+y is 0 to 10.)

(F)

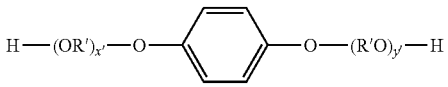

(In the formula, R' represents —$CH_2CH_2$—, —$CH_2$—C($CH_3$)H—, or —$CH_2$—C($CH_3$)$_2$—, x' and y' each represent an integer of 0 or more, and the average of x'+y' is 0 to 10.)

Examples of a divalent acid component include dicarboxylic acids and derivatives thereof such as: benzene dicarboxylic acids, or anhydrides or lower alkyl esters thereof such as phthalic acid, terephthalic acid, isophthalic acid, and phthalic anhydride; alkyldicarboxylic acids, or anhydrides or lower alkyl esters thereof such as succinic acid, adipic acid, sebacic acid, and azelaic acid; alkenylsuccinic acids or alkylsuccinic acids, or anhydrides or lower alkyl esters thereof such as n-dodecenylsuccinic acid and n-dodecylsuccinic acid; and unsaturated dicarboxylic acids, or anhydrides or lower alkyl esters thereof such as fumaric acid, maleic acid, citraconic acid, and itaconic acid.

In addition, a trihydric or more polyhidric alcohol component and a trivalent or more polyvalent acid component, serving as cross-linking components, are preferably used in combination.

Examples of a polyhydric alcohol component which is trihydric or more include: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methyl propanetriol; 2-methyl-1,2,4-butanetriol; trimethylolethane; trimethylolpropane; and 1,3,5-trihydroxybenzene.

Examples of a polyvalent carboxylic acid component which is trivalent or more polyvalent in the present invention include polycarboxylic acids and derivatives thereof such as: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, and an enpol trimer acid, and anhydrides and lower alkyl esters thereof; and tetracarboxylic acids each represented by the following formula, and anhydrides and lower alkyl esters thereof.

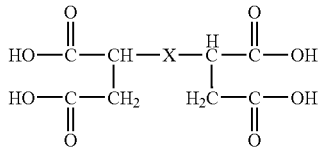

(In the formula, X represents an alkylene or alkenylene group having: one or more sides chains each having 3 or more carbon atoms; and 5 to 30 carbon atoms.)

The amount of an alcohol component to be used in the present invention is 40 to 60 mol %, or preferably 45 to 55 mol %, while the amount of an acid component is 60 to 40 mol %, or preferably 55 to 45 mol %. In addition, a polyvalent component which is trivalent or more polyvalent preferably accounts for 5 to 60 mol % of all components.

The polyester resin can also be obtained by means of condensation polymerization generally known.

Hereinafter, methods of measuring physical properties according to the present invention will be described.

[Measurement of THF Insoluble Matter]

About 1.0 g (W1 g) of a resin is weighed and loaded into a cylindrical paper filter (for example, No. 86 R size 28×100 mm manufactured by Toyo Roshi Sha), and subjected to a Soxhlet extractor and extracted for 16 hours by means of 200 ml of THF as a solvent. At this time, extraction is performed at the reflux rate at which the extraction cycle of the solvent is once per about 4 to 5 minutes. After the completion of the extraction, the cylindrical paper filter is taken out and dried in a vacuum at 40° C. for 8 hours, and the extraction residue is weighed (W2 g). Next, the weight of incinerated residue in toner is determined (W3 g). The weight of the incinerated residue is determined in accordance with the following procedure. About 2 g of a sample is loaded into a 30-ml magnetic crucible that has been precisely weighed in advance, and precisely weighed. Then, the mass of the crucible is subtracted to determine the mass (Wa g) of the toner as a sample. The crucible is placed in an electric furnace and heated at about 900° C. for about 3 hours. The crucible is left standing to cool in the electric furnace and then left standing to cool for 1 hour or longer in a desiccator at room temperature, and then the mass of the crucible is precisely weighed. The mass of the crucible is subtracted from the result to determine the weight of the incinerated ash (Wb g).

$$(Wb/Wa)\times 100=\text{Incinerated residue content (mass \%)}$$

The mass (W3 g) of the incinerated residue in W1 g of the sample can be determined from the content.

The THF insoluble matter can be determined from the following expression.

$$\text{THF insoluble matter (mass \%)}=\{(W2-W3)/(W1-W3)\}\times 100$$

The THF insoluble matter of a sample containing no component other than a resin such as a binder resin can be determined from the following expression by precisely weighing a predetermined amount (W1 g) of the resin and determining the extraction residue (W2 g) of the resin through the same step as described above.

$$\text{THF insoluble matter (mass \%)}=(W2/W1)\times 100$$

[Measurement of Molecular Weight Distribution by Means of GPC]

A column is stabilized in a heat chamber at 40° C. THF as a solvent is allowed to flow into the column at the temperature at a flow rate of 1 ml/min. After that, about 100 μl of a THF sample solution are injected to perform measurement. In measuring the molecular weight of the sample, the molecular weight distribution of the sample is calculated from the relationship between a logarithmic value of a calibration curve prepared by using several kinds of monodisperse polystyrene standard samples and the number of counts. The standard polystyrene samples used for preparing the calibration curve are, for example, those manufactured by Tosoh Corporation or by Showa Denko K.K. each having a molecular weight of about $10^2$ to $10^7$, and at least about ten standard polystyrene samples are suitably used. In addition, a refractive index (RI) detector is used as a detector. Referring to columns, it is recommended that commercially available polystyrene gel columns are combined to be used. Examples of the combination include: a combination of SHODEX GPC KF-801, 802, 803, 804, 805, 806, 807, and 800P manufactured by Showa Denko K.K.; and a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSK guard column manufactured by Tosoh Corporation.

The sample is put into THF, and the whole is left for several hours. After that, the resultant is sufficiently shaken so that the sample and THF are thoroughly mixed with each other (until the aggregates of the sample disappear), and left standing for additional 12 hours or longer. At that time, the period for which the sample is left standing in THF should be 24 hours or longer. After that, the resulting product is passed through a sample treating filter (pore size: 0.2 to 0.5 μm; for example, a MYSHORI DISK H-25-2 (manufactured by Tosoh Corporation) can be used) and used as a sample for GPC. In addition, the sample concentration is adjusted so that the concentration of the resin component is 0.5 to 5.0 mg/ml.

[Measurement of Acid Value]

The basic operation is in conformity with JIS K-0070.

1) 0.5 to 2.0 g of a sample is precisely weighed and the value is defined as the mass w (g) of the sample.
2) The sample is placed into a 300 ml beaker, and 150 ml of a mixed solution of toluene/ethanol (4/1) are added to dissolve the sample.
3) The resultant is titrated with a 0.1 mol/l solution of KOH in methanol by using a potentiometric titration device (for example, automatic titration using a potentiometric titration device AT-400 (win workstation) manufactured by Kyoto Denshi and an electrically operated bullet ABP-410 can be utilized).
4) The amount of the KOH solution used at this time is denoted by S (ml). At the same time, a blank is measured, and the amount of the KOH solution used at this time is denoted by B (ml).
5) An acid value is calculated from the following expression where f represents the factor of KOH.

$$\text{Acid value (mgKOH/g)}=\{(S-B)\times f\times 5.61\}/W$$

When a developer is used as a sample, the incinerated residue is determined as in the case of the measurement of THF insoluble matter, and the value obtained by subtracting the mass of the incinerated residue is defined as the mass of the sample.

[Particle Size Distribution of Developer]

The particle size distribution of the developer can be measured by various methods. In the present invention, a COULTER COUNTER is used. A COULTER MULTISIZER IIE (manufactured by Beckman Coulter, Inc) is used as a measuring device. An about 1% aqueous solution of NaCl prepared by using first grade sodium chloride is used as an electrolyte. For example, an ISOTON (R)-II (manufactured by Coulter Scientific Japan, Co.) can be used. A measurement method is as follows. 100 to 150 ml of an aqueous solution of the electrolyte is added with 0.1 to 5.0 ml of a surfactant (preferably an alkyl benzene sulfonate) as a dispersant. Then, 2 to 20 mg of a measurement sample is added to the resultant. The electrolyte into which the sample is suspended is dispersed for about 1 to 3 minutes by means of an ultrasonic dispersing device. After that, using a 100 μm aperture as an aperture, the volume and number of toner particles are measured by means of the above measuring device so that volume distribution and number distribution are calculated. At this time, the measured data is obtained in the form of channels as a result of dividing a particle size range of 1.59 to 64.0 μm into 256 sections. The data obtained in the form of 256 channels is used to determine a weight average particle size (D4) (the central value of each channel is defined as a representative value for the channel), a number average particle size (D1), the amount of a coarse powder (having a particle size of 10.1 μor more) determined from the volume distribution, and the number of fine powder particles (each having a particle size of 4.00 μm or less) determined from the number distribution.

[Half Width Y with Respect to Peak Particle Size X in Number-Based Particle Size Distribution of Developer]

A frequency A (number %) at the peak particle size X is calculated from the particle size distribution (see FIG, 4) of the 256 channels measured by means of a COULTER MULTISIZER IIE (manufactured by Beckman Coulter, Inc).

When the frequency at the peak particle size X is denoted by A, particle sizes at each of which a frequency is one half the frequency (i.e., A/2) are calculated from the particle size distribution, and are denoted by X1 and X2 from the smaller particle size side.

At this time, the half width Y can be found from the expression Y=X2−X1.

Any one of such waxes as described below is preferably incorporated into the developer of the present invention so that releasability is imparted to the developer. Examples of waxes to be used in the present invention include: aliphatic hydrocarbon-based waxes such as low-molecular-weight polyethylene, low-molecular-weight polypropylene, a polyolefin copolymer, a polyolefin wax, a microcrystalline wax, a paraffin wax, and a Fischer-Tropsch wax; oxides of aliphatic hydrocarbon-based waxes such as a polyethylene oxide wax, or block copolymers of the waxes; plant-based waxes such as a chandelle wax, a carnauba wax, a haze wax, and a jojoba wax; animal-based waxes such as a bees wax, lanolin, and a spermaceti wax; mineral-based waxes such as ozokerite, ceresin, and petrolatum; waxes mainly composed of fatty acid esters such as a montanic acid ester wax and a castor wax; and partially or wholly deoxidized fatty acid esters such as a deoxidized carnauba wax. The examples further include: saturated straight-chain fatty acids such as palmitic acid, stearic acid, montanic acid, and a long-chain alkylcarboxylic acid having an additionally long alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and a long-chain alkyl alcohol having an additionally long alkyl group; polyhydric alcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty amides such as ethylene bis oleamide, hexamethylene bis oleamide, N,N'-dioleyl adipamide, and N,N'-dioleyl sebacamide; aromatic bis amides such as m-xylene bis stearamide and N-N'-distearyl isophthalamide; aliphatic metal salts (what are generally referred to as metallic soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products of fatty acids and polyhydric alcohols such as behenic monoglyceride; and methyl ester compounds each having a hydroxyl group obtained by the hydrogenation of vegetable oil.

Examples of a wax to be preferably used include: polyolefin obtained by subjecting an olefin to radical polymerization under a high pressure; polyolefin obtained by purifying a low-molecular-weight by-product produced upon polymerization of high-molecular-weight polyolefin; polyolefin polymerized under a low pressure by means of a catalyst such as a Ziegler catalyst or a metallocene catalyst; polyolefin polymerized by means of radiation, an electromagnetic wave, or light; low-molecular-weight polyolefin obtained by the thermal decomposition of high-molecular-weight polyolefin; a paraffin wax, a microcrystalline wax; a synthetic hydrocarbon wax synthesized by means of an Arge method, a synthol method, a hydrocol method, or the like (such as a Fischer-Tropsch wax); a synthetic wax using a compound having 1 carbon atom as a monomer; a hydrocarbon-based wax having a functional group such as a hydroxy group or a carboxyl group; a mixture of a hydrocarbon-based wax and a wax having a functional group; and a wax obtained by subjecting any one of these waxes as a parent body to graft denaturation with a vinyl monomer such as styrene, maleate, acrylate, methacrylate, or maleic anhydride.

Any one of those waxes adapted to have sharp molecular weight distribution by means of a press sweating method, a solvent method, a recrystallization method, a vacuum distillation method, a supercritical gas extraction method, or a molten liquid crystal method, or any one of those waxes from which a low-molecular-weight solid fatty acid, a low-molecular-weight solid alcohol, a low-molecular-weight solid compound, or any other impurity is removed is also preferably used.

The amount of the above wax to be added is preferably 0.1 to 20 parts by mass, or more preferably 1 to 10 parts by mass with respect to 100 parts by mass of the binder resin. Two or more of the waxes may be added in combination.

The endothermic curve of a developer added with any one of those waxes measured by means of DSC preferably has the highest peak in the region of 60 to 120° C.

Where the highest peak is present in this range good fixability and good offset resistance are provided. When the highest endothermic peak temperature is lower than 60° C., the storage stability of the developer itself deteriorates owing to the plasticizing effect of the wax. When the highest endothermic peak temperature exceeds 120° C., fixability deteriorates.

The developer of the present invention is characterized by containing magnetic iron oxide. Incorporating the magnetic iron oxide into a toner particle can equalize the surface resistance of the toner particle to that of the inorganic fine powder. As a result, the interchange of charges between the toner particle surface and the inorganic fine powder can be easily performed, and the effect of alleviating the cohesiveness between particles can be more effectively exhibited.

The number average particle size of the magnetic iron oxide of the present invention is preferably 0.05 to 1.00 μm, or more preferably 0.10 to 0.60 μm.

The magnetic iron oxide used in the present invention is preferably in octahedronal shape or multinuclear shape from the viewpoint of fine dispersibility into a toner particle. Furthermore, the magnetic iron oxide of the present invention is preferably subjected to treatment involving: applying shear force to slurry at the time of production; and disintegrating the produced magnetic iron oxide once for the purpose of improving fine dispersibility into a toner particle.

The amount of the magnetic iron oxide to be incorporated into a toner particle in the present invention is 10 to 200 parts by mass, preferably 20 to 170 parts by mass, or more preferably 30 to 150 parts by mass with respect to 100 parts by mass of a binder resin.

A charge control agent is preferably incorporated into the developer to be used in the present invention in order to cause the developer to maintain positive chargeability. In particular, the charge control agent is preferably at least one of a triphenylmethane compound and a quaternary ammonium salt. The use of such charge control agent can quickly give charges to the developer even in high-speed printing. Furthermore, the use of such charge control agent can alleviate the cohesion between developer particles with improved effectiveness.

The developer of the present invention may be added with any other external additive as required.

Examples of such external additive include resin fine particles and inorganic fine particles each serving as a charging auxiliary agent, a conductive imparting agent, a flowability imparting agent, a caking inhibitor, a release agent at the time of fixation using a heat roller, a lubricant, an abrasive, or the like.

Examples of the lubricant include a polyethylene fluoride powder, a zinc stearate powder, and a polyvinylidene fluoride powder. Of those, a polyvinylidene fluoride powder is preferable. Examples of the abrasive include a cerium oxide powder, a silicon carbide powder, and a strontium titanate powder. Of those, a strontium titanate powder is preferable.

As described above, a unconfined yield strength at a specific major consolidation stress can be easily controlled by controlling the cohesion between particles of a positively chargeable developer including positively chargeable toner particles each containing at least a binder resin and magnetic iron oxide. In addition, satisfying a unconfined yield strength specified in the present invention can provide a developer which causes no toner deterioration even in high-speed printing, has durability, and is excellent in image quality.

In the present invention, such a method as described below can be used for producing a toner particle. That is, the toner of the present invention can be produced by: sufficiently mixing a binder resin, a colorant, any other additive, and the like by using a mixer such as a HENSCHEL MIXER or a ball mill; melting and kneading the mixture by means of a heat kneader such as a heating roll, a kneader, or an extruder; cooling the kneaded product for solidification; pulverizing and classifying the solidified product; and sufficiently mixing the pulverized and classified product with desired additives as required by using a mixer such as a HENSCHEL MIXER.

For example, examples of the mixer include: HENSCHEL MIXER (manufactured by MITUI MINING. Co., Ltd.); SUPER MIXER (manufactured by KAWATA MFG Co., Ltd); RIBOCONE (manufactured by OKAWARA CORPORATION); NAUTA MIXER, TURBURIZER, and CYCLOMIX (manufactured by Hosokawa Micron); SPIRAL PIN MIXER (manufactured by Pacific Machinery & Engineering Co., Ltd); and LOEDIGE MIXER (manufactured by MATSUBO Corporation). Examples of the kneader include: KRC kneader (manufactured by Kurimoto Ironworks Co., Ltd.); BUSS CO-KNEADER (manufactured by Buss Co., Ltd), TEM-type extruder (manufactured by TOSHIBA MACHINE Co., Ltd); TEX BIAXIAL KNEADER (manufactured by The Japan Steel Works, Ltd); PCM BIAXIAL KNEADER (manufactured by Ikegai machinery Co.); THREE-ROLL MILL, MIXING ROLL MILL, and KNEADER (manufactured by Inoue Manufacturing Co., Ltd); KNEADEX (manufactured by Mitsui Mining Co., Ltd.); MS-TYPE PRESSURE KNEADER, and KNEADER-RUDER (manufactured by Moriyama Manufacturing Co., Ltd.); and BANBURY MIXER (manufactured by Kobe Steel, Ltd.). Examples of the mill include: COUNTER JET MILL, MICRON JET, and INOMIZER (manufactured by Hosokawa Micron); IDS-TYPE MILL and PJM JET MILL (manufactured by Nippon Pneumatic MFG Co., Ltd.); CROSS JET MILL (manufactured by Kurimoto Tekkosho KK); ULMAX (manufactured by Nisso Engineering Co., Ltd.); SK JET O-MILL (manufactured by Seishin Enterprise Co., Ltd.); CRIPTRON (manufactured by Kawasaki Heavy Industries, Ltd); TURBO MILL (manufactured by Turbo Kogyo Co., Ltd.); and SUPER ROTOR (manufactured by Nisshin Engineering Inc.). Examples of the classifier include: CLASSIEL, MICRON CLASSIFIER, and SPEDIC CLASSIFIER (manufactured by Seishin Enterprise Co., Ltd.); TURBO CLASSIFIER (manufactured by Nisshin Engineering Inc.); MICRON SEPARATOR, TURBOPREX (ATP), and TSP SEPARATOR (manufactured by Hosokawa Micron); ELBOW JET (manufactured by Nittetsu Mining Co., Ltd.); DISPERSION SEPARATOR (manufactured by Nippon Pneumatic MFG Co,, Ltd.); and YM MICROCUT (manufactured by Yasukawa Shoji K.K.). Examples of the sieve device include: ULTRA SONIC (manufactured by Koei Sangyo Co., Ltd.); REZONA SIEVE and GYRO SIFTER (manufactured by Tokuju Corporation); VIBRASONIC SYSTEM (manufactured by Dalton Co., Ltd); SONICREEN (manufactured by Shinto Kogyo K.K.); TURBO SCREENER (manufactured by Turbo Kogyo Co., Ltd.); MICROSIFTER (manufactured by Makino mfg. co., ltd.); and circular vibrating sieves.

The developer of the present invention can be further suitably used for an image forming method including at least a developing step of developing an electrostatic latent image formed on a latent image-bearing member with a developer layer formed on a developer carrying member to form a developer image, in which torque (T) to be applied to the developer carrying member in a state in which the developer layer is formed satisfies the relationship of $0.1\ N\cdot m \leqq T \leqq 50\ N\cdot m$.

In addition, the developer of the present invention can be further suitably used for an image forming method including transferring the developer image onto a transfer material conveyed on an endless transfer material conveying means to which a voltage opposite in polarity to the charged polarity of toner is applied by bringing the developer image into contact with the transfer material, in which: the endless transfer material conveying means is a transfer belt; the transfer belt is tensioned by at least two rollers placed on the upstream side and downstream side of a portion in contact with the latent image-bearing member with respect to the direction in which the transfer material is conveyed; and the penetration i of the transfer belt with respect to the surface of the photosensitive member at the portion in contact with the latent image-bearing member satisfies the relationship of $0\% < i \leqq 5\%$ with respect to the diameter d of the latent image-bearing member. Where the developer of the present invention is applied to such image forming method, the effect of preventing transfer voids and the effect of suppressing the contamination of the transfer belt can be stably exhibited even when the transfer belt is used to continuously obtain print images at a high speed for a long time period.

Such an image forming method as described above may use a latent image-bearing member including: a conductive substrate; a photoconductive layer on the conductive substrate, containing at least amorphous silicon; and a surface protective layer on the photoconductive layer, containing amorphous silicon and/or amorphous carbon and/or amorphous silicon nitride.

EXAMPLES

Hereinafter, the present invention will be described specifically by way of examples. However, the embodiments of the present invention are not limited to the examples.

<Production Example of Low-Molecular-Weight Component (B-1)>

300 parts by mass of xylene was placed in a four-necked flask, and the air in the container was sufficiently replaced with nitrogen while the contents in the container were stirred. After that, the temperature of the container was raised to reflux the contents.

Under the reflux, a mixed solution of 76.0 parts by mass of styrene, 24.0 parts by mass of n-butyl acrylate, and 2 parts by mass of di-tert-butyl peroxide (Initiator 1; half-life 10-hour; temperature: 129° C.) was dropped over 4 hours. After that, the resultant was held for 2 hours to complete polymerization. Thus, a low-molecular-weight polymer solution (B-1) was produced.

<Production Example of Low-Molecular-Weight Component (B-2)>

Polymerization was performed in the same manner as in Production example of the low-molecular-weight component B-1 by the use of 77.0 parts by mass of styrene, 23.0 parts by mass of n-butyl acrylate, and 2.5 parts by mass of Initiator 1 to produce a low-molecular-weight polymer solution B-2.

<Production Example of Low-Molecular-Weight Component (B-3)>

Polymerization was performed in the same manner as in Production example of the low-molecular-weight component B-1 by the use of 73.0 parts by mass of styrene, 23.0 parts by mass of n-butyl acrylate, 4.0 parts by mass of mono n-butyl maleate, and 2.5 parts by mass of Initiator 1 to produce a low-molecular-weight polymer solution B-3.

<Production Example of High-Molecular-Weight Component (A-1)>

180 parts by mass of deaerated water and 20 parts by mass of a 2-mass % aqueous solution of polyvinyl alcohol were placed in a four-necked flask. Then, a mixed solution of 71.0 parts by mass of styrene, 24.0 parts by mass of n-butyl acrylate, 5.0 parts by mass of mono n-butyl maleate, 0.005 part by mass of divinylbenzene, and 0.1 part by mass of 2,2-bis(4,4-di-tert-butylperoxycyclohexyl)propane (Initiator 2; half-life 10-hour temperature: 92° C.) was added to the flask. Then, the mixture was stirred to prepare a suspension.

After the air in the flask had been sufficiently replaced with nitrogen, the temperature of the flask was raised to 85° C. to initiate polymerization. After the temperature of the flask had been held at the temperature for 24 hours, 0.1 part by mass of benzoyl peroxide (half-life 10-hour temperature: 72° C.) was added. The temperature of the flask was held at the temperature for additional 12 hours to complete the polymerization. After that, the high-molecular-weight polymer was filtered off, washed with water, and dried to produce a high-molecular-weight component (A-1).

<Production Example of High-Molecular-Weight Component (A-2)>

70.0 parts by mass of styrene, 27.0 parts by mass of n-butyl acrylate, 3.0 parts by mass of mono n-butyl maleate, 0.005 part by mass of divinylbenzene, and 1 part by mass of Initiator 2 were used in the same manner as in Production example of the high-molecular-weight component (A-1) to produce a high-molecular-weight component (A-2).

<Production Example of High-Molecular-Weight Component (A-3)>

300 parts by mass of xylene was placed in a four-necked flask, and the air in the container was sufficiently replaced with nitrogen while the contents in the container were stirred. After that, the temperature of the container was raised to reflux the contents.

Under the reflux, at first, a mixed solution of 81.0 parts by mass of styrene, 15.0 parts by mass of n-butyl acrylate, and 0.8 part by mass of Initiator 2 was dropped over 4 hours. After the mixed solution had been dropped for 2 hours, a mixed solution of 4.0 parts by mass of methacrylic acid and 0.2 part by mass of Initiator 2 was dropped over 2 hours. After all the mixed solutions had been dropped, the resultant was held for 2 hours to complete polymerization. Thus, a solution of a high-molecular-weight component (A-3) was produced.

<Production Example of Binder Resin (C-1)>

200 parts by mass of a solution of the low-molecular-weight component (B-2) in xylene (corresponding to 60 parts by mass of the low-molecular-weight component) were placed in a four-necked flask. After that, the temperature of the flask was raised, and the contents in the flask were stirred under reflux. Meanwhile, 200 parts by mass of a solution of the high-molecular-weight component (A-3) (corresponding to 40 parts by mass of the high-molecular-weight component) was placed in another container and refluxed. After the solution of the low-molecular-weight component (B-2) and the solution of the high-molecular-weight component (A-3) had been mixed under reflux, an organic solvent was distilled off, and the resultant resin was cooled, solidified, and pulverized to produce a resin (C-1). Table 1 shows the physical properties of the resultant resin.

<Production Example of Binder Resin (C-2)>

200 parts by mass of a solution of the low-molecular-weight component (B-1) in xylene (corresponding to 70 parts by mass of the low-molecular-weight component) were loaded into a four-necked flask. After that, the temperature of the flask was raised, and the contents in the flask were stirred under reflux. 30 parts by mass of the high-molecular-weight component (A-2) were placed in the flask and refluxed. After the solution of the low-molecular-weight component (B-1) and the high-molecular-weight component (A-2) had been mixed under reflux, an organic solvent was distilled off, and the resultant resin was cooled, solidified, and pulverized to produce a resin (C-2). Table 1 shows the physical properties of the resultant resin.

<Production Example of Binder Resin (C-3)>

200 parts by mass of a solution of the low-molecular-weight component (B-1) in xylene (corresponding to 80 parts by mass of the low-molecular-weight component) was placed in a four-necked flask. After that, the temperature of the flask was raised, and the contents in the flask were stirred under reflux. 20 parts by mass of the high-molecular-weight component (A-1) was placed in the flask and refluxed. After the solution of the low-molecular-weight component (B-1) and the high-molecular-weight component (A-1) had been mixed under reflux, an organic solvent was distilled off, and the resultant resin was cooled, solidified, and pulverized to produce a resin (C-3). Table 1 shows the physical properties of the resultant resin.

<Production Example of Binder Resin (C-4)>

200 parts by mass of a solution of the low-molecular-weight component (B-3) in xylene (corresponding to 70 parts by mass of the low-molecular-weight component) was placed in a four-necked flask. After that, the temperature of the flask was raised, and the contents in the flask were stirred under reflux. 30 parts by mass of the high-molecular-weight component (A-1) was placed in the flask and refluxed. After the solution of the low-molecular-weight component (B-3) and the high-molecular-weight component (A-1) had been mixed under reflux, an organic solvent was distilled off, and the resultant resin was cooled, solidified, and pulverized to produce a resin (C-4). Table 1 shows the physical properties of the resultant resin.

Example 1

Binder resin C-1 100 parts by mass

Magnetic iron oxide particles (octahedron, number average particle size: 0.20 μm)

90 parts by mass

Wax b (Fischer-Tropsch wax, Table 2 shows the physical properties. Highest endothermic peak temperature: 101° C., number average molecular weight: 1,500, weight average molecular weight: 2,500)

4 parts by mass

Charge control agent A (triphenylmethane lake pigment shown below) 2 parts by mass After the above materials had been pre-mixed by means of a HENSCHEL MIXER, the mixture was melted and kneaded by means of a biaxial kneading extruder.

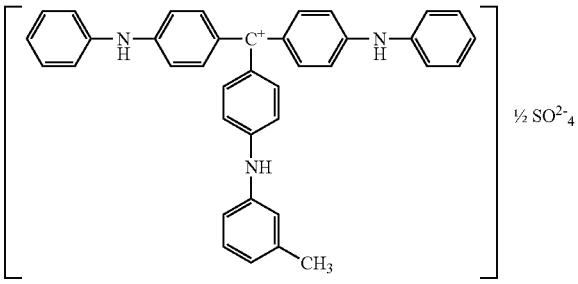

The resultant kneaded product was cooled and coarsely pulverized by means of a hammer mill. After that, the coarsely pulverized product was finely pulverized by means of a pulverizer using a jet stream, and the resultant finely pulverized powder was classified by means of a multi-division classifier utilizing a Coanda effect to produce toner particles. The zeta potential of the toner particles was measured. As a result, the pH of a dispersion liquid was 4, and the value for the zeta potential was 42 mV. The following three kinds of external additives were externally added to and mixed with 100 parts by mass of the toner particles, and the mixture was sieved by means of a mesh having an aperture of 150 μm to produce a developer 1.

Hydrophobic silica fine powder a (having a methanol concentration of 75% at a transmittance of 80% and a BET specific surface area of 110 $m^2/g$) prepared by treating 100 parts by mass of the base material of a silica fine powder (having a BET specific surface area of 200 $m^2/g$) with 17 parts by mass of amino-denatured silicone oil (silicone oil using dimethyl silicone oil as a main skeleton, amino equivalent=830, viscosity at 25° C.=70 $mm^2/s$)

0.8 part by mass

Alumina particles (zeta potential at pH=4: 36.5 mV, BET specific surface area: 100 $m^2/g$)

0.2 part by mass

Strontium titanate (having a number average primary particle size of 1.5 μm)

3.0 parts by mass

Figure 3:
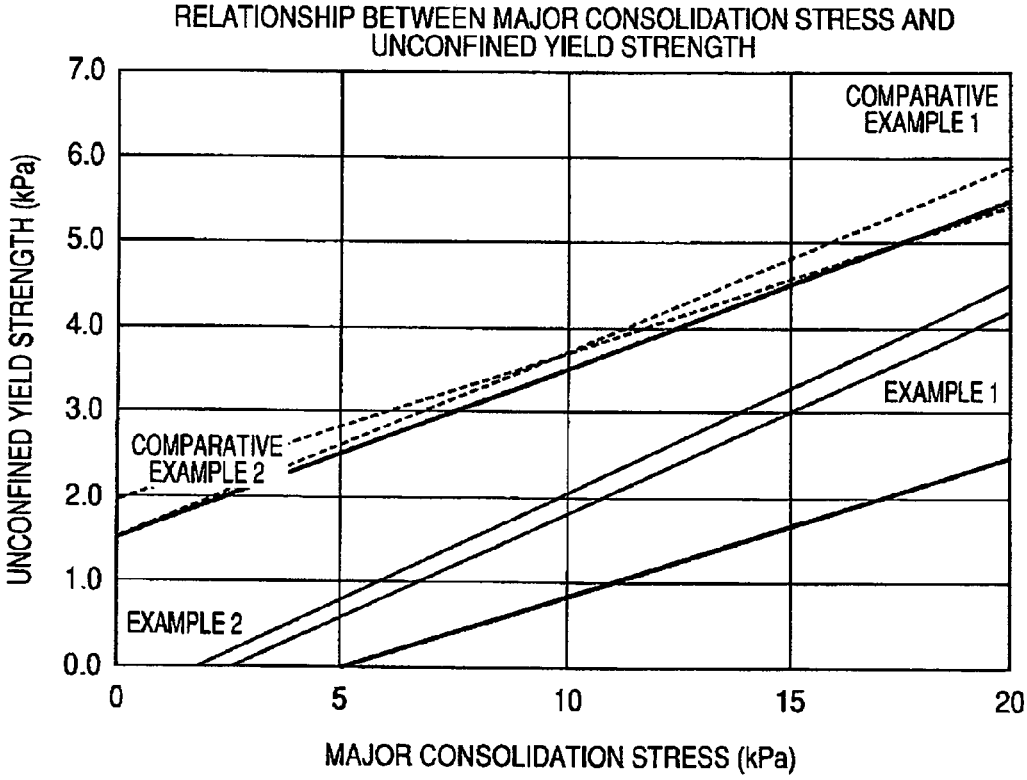
FIG. 3 is a view showing a relationship between a major consolidation stress and a unconfined yield strength.
Figure 4:
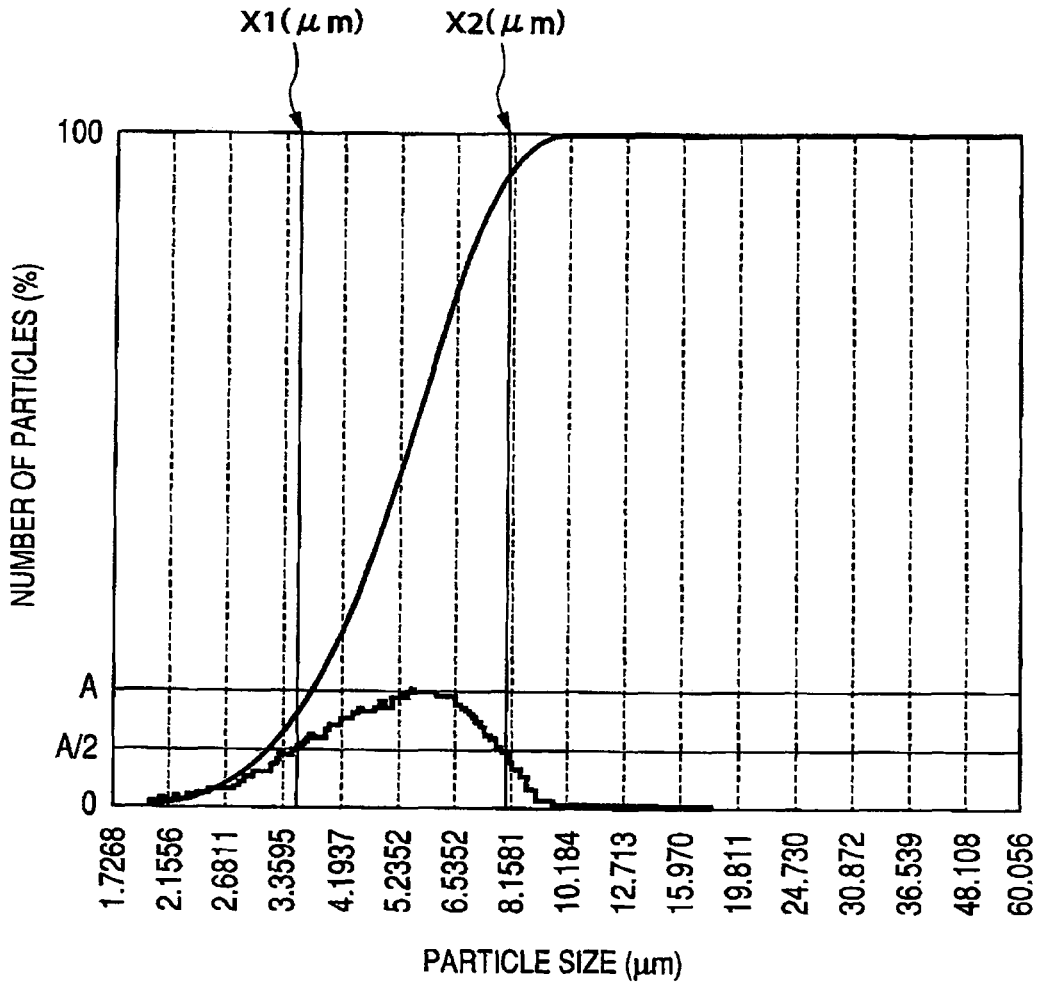
FIG. 4 shows an example of the particle size distribution of 256 channels obtained by means of a COULTER MULTISIZER IIE (manufactured by Beckman Coulter).

Table 3 shows the internal addition formulation of toner particles and the physical property values of a developer. FIG. 3 shows the relationship between a major consolidation stress and a unconfined yield strength.

A 200,000-sheet continuous print test was conducted on a test chart having a printing ratio of 4% in each of a normal temperature and low humidity (23° C., 5% RH) environment, a normal temperature and normal humidity (23° C., 60% RH) environment, and a high temperature and high humidity (32° C., 80% RH) environment by using the developer 1, a commercially available copying machine (IR-105, manufactured by CANON Inc.) modified to have 1.5 times the print speed of an unmodified one, and a developing unit shown in FIG. 1 obtained by adjusting the gap width of the regulating member 104 from the surface of the developer carrying member 102 to be 235 μm. At this time, before the print test was performed, a developer remaining amount detecting portion was adjusted in such a manner that the amount of the developer in a developer container was around 400 g at all times. The torque to be applied to the developer carrying member 102 of the developing unit at this time was actually measured by means of a torque meter and found to be 0.2 N·m.

Evaluation for Image Density

The reflection density of a 5 mm square image was measured by means of a MACBETH DENSITOMETER (manufactured by Gretag Macbeth) with the aid of an SPI filter. Evaluation of image density was made at the initial stage and on the 200,000th sheet.

Evaluation of Fogging

A reflection densitometer (Reflectometer model TC-6DS manufactured by Tokyo Denshoku Co., Ltd.) was used to measure the worst value of the reflection density of a white background after image formation and the average reflection density of a transfer material before image formation. The worst value was denoted by Ds, the average reflection density was denoted by Dr, and the value of Ds−Dr was used as a fogging amount to evaluate fogging. The smaller the value of Ds−Dr, the better the suppression of fogging is. Evaluation of fogging was made at the initial stage and on the 200,000th sheet.

Evaluation of Image Quality

With regard to image quality as well, the above image formation testing machine was used for evaluation to reproduce an isolated 1-dot pattern of 1,200 dpi in the normal temperature and normal humidity environment. The image was observed with an optical microscope to evaluate dot reproducibility.

A: No toner lies off a latent image, and a dot is completely reproduced.

B: Toner slightly lies off a latent image.

C: Toner considerably lies off a latent image.

Evaluation of Toner Consumption

With regard to a toner consumption as well, the above image formation testing machine was used to carry out image formation on 1,000 sheets in the normal temperature and normal humidity environment. After that, setting was performed in such a manner that a latent image line width is so set as to be about 190 μm in a 4-dot horizontal line pattern of 600 dpi, and then an image having a printing ratio of 6% was reproduced on 5,000 sheets of A4-size paper. A consumption was determined from a change in an amount of toner in a developing unit.

Evaluation for Line Width

With regard to a line width as well, the above image formation testing machine was used to draw 4-dot horizontal line patterns of 600 dpi (each having a latent image line width of about 190 μm) at an interval of 1 cm in the normal temperature and normal humidity environment. The latent images were developed, and then transferred and fixed onto an OHP made of PET. How toner was mounted on a horizontal line of the resultant horizontal line pattern image was determined as a profile for surface roughness by means of a surface roughness meter SURFCORDER SE-30H (manufactured by Kosaka Laboratory Ltd.), and a line width was determined from the width of the profile. An image with the highest definition was obtained when the line width was slightly larger than the latent image line width. The reproducibility of a fine line was lowered as the line width becomes smaller than the latent image line width.

Tables 4 to 6 show the results of the above evaluation.

A developing unit obtained by changing the regulating member 104 of the developing unit of the above image formation testing machine to an elastic member and setting the pressure to be applied to the surface of the developer carrying member 102 in the layer thickness regulating portion to be 100 g/cm$^2$ was filled with 400 g of the developer 1. Then, a change in charge amount before and after idling the developer carrying member in the normal temperature and normal humidity environment at a process speed of 600 mm/sec for 60 minutes was evaluated. The torque to be applied to the developer carrying member 102 at this time was actually measured by means of a torque meter and found to be 10 N·m.

A: A change in charge amount before and after the idling is less than 3 mC/kg.

B: A change in charge amount before and after the idling is 3 to 6 mC/kg.

C: A change in charge amount before and after the idling is larger than 6 mC/kg.

Example 2

A developer 2 was produced in the same manner as in Example 1 except that the formulation described in Table 3 was adopted (see Table 1 for a binder resin and Table 2 for a wax). The toner particles in the developer 2 were dispersed into water, and the pH of the dispersion liquid was measured. The pH was 4. Table 3 shows the physical properties of the developer thus obtained. Tables 4 to 6 show the results of the same tests as those of Example 1.

It should be noted that the pH of the dispersion liquid prepared by dispersing the toner particles according to each of Examples 3 to 7 and Comparative Examples 1 to 5 into water was 4.

Example 3

A developer 3 was produced in the same manner as in Example 1 except that the formulation described in Table 3 was adopted (see Table 1 for a binder resin and Table 2 for a wax). Zinc oxide particles used instead of alumina particles as an inorganic fine powder had a zeta potential of 8.3 mV at pH=4 and a BET specific surface area of 30 m$^2$/g. Table 3 shows the physical properties of the developer thus obtained. Tables 4 to 6 show the results of the same tests as those of Example 1.

Example 4

A developer 4 was produced in the same manner as in Example 1 except that the formulation described in Table 3 was adopted (see Table 1 for a binder resin and Table 2 for a wax). Magnesium oxide particles used instead of alumina particles as an inorganic fine powder had a zeta potential of 44.3 mV at pH=4 and a BET specific surface area of 5.3 m$^2$/g. Table 3 shows the physical properties of the developer thus obtained. Tables 4 to 6 show the results of the same tests as those of Example 1.

Example 5

A developer 5 was produced in the same manner as in Example 1 except that the formulation described in Table 3 was adopted (see Table 1 for a binder resin and Table 2 for a wax). A charge control agent B is a quaternary ammonium salt having the following structure, and magnetic iron oxide particles each having a multinuclear shape have a number average particle size of 0.19 μm. In addition, zinc oxide particles used instead of alumina particles as an inorganic fine powder were the same as those used in Example 3, and the amount of the particles to be added was 0.5 part by mass. A silica fine powder b is a hydrophobic silica fine powder which is prepared by treating 100 parts by mass of a silica base material (having a BET specific surface area of 200 m$^2$/g) with 15 parts by mass of amino-denatured silicone oil (silicone oil using dimethyl silicone oil as a main skeleton, amino equivalent=830, viscosity at 25° C.=70 mm$^2$/s) and 2 parts by mass of an aminosilane coupling agent at the same time and which has a methanol concentration of 69% at a transmittance of 80%. Table 3 shows the physical properties of the developer thus obtained. Tables 4 to 6 show the results of the same tests as those of Example 1.

[Example 6]

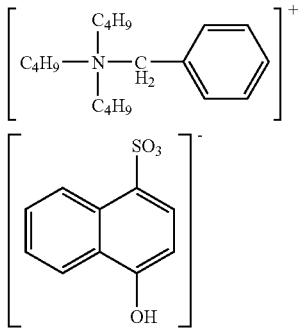

A developer 6 was produced in the same manner as in Example 1 except that the formulation described in Table 3 was adopted (see Table 1 for a binder resin and Table 2 for a wax). Magnetic iron oxide particles each having a multinuclear shape were the same as those used in Example 5. Table 3 shows the physical properties of the developer thus obtained. Tables 4 to 6 show the results of the same tests as those of Example 1.

Example 7

A developer 7 was produced in the same manner as in Example 1 except that the formulation described in Table 3 was adopted (see Table 1 for a binder resin and Table 2 for a wax) and 2 parts of the wax a and 4 parts of the wax b were used. Zinc oxide particles used instead of alumina particles as an inorganic fine powder were the same as those used in Example 3. Table 3 shows the physical properties of the developer thus obtained. Tables 4 to 6 show the results of the same tests as those of Example 1.

Comparative Examples 1 to 5

Each of developers 8 to 12 was produced in the same manner as in Example 1 except that the formulation described in Table 3 was adopted (see Table 1 for a binder resin and Table 2 for a wax). Table 3 shows the physical properties of the developers thus obtained. Tables 4 to 6 show the results of the same tests as those of Example 1. A charge control agent C is nigrosin. In addition, titanium oxide particles used instead of alumina particles as an inorganic fine powder had a zeta potential of 2.1 mV at pH=4 and a BET specific surface area of 100 $m^2/g$. Furthermore, silica particles used instead of alumina particles as an inorganic fine powder had a zeta potential of −9.5 mV at pH=4 and a BET specific surface area of 50 $m^2/g$.

TABLE 1

| | | C-1 | C-2 | C-3 | C-4 |
|---|---|---|---|---|---|
| Formulation | High-molecular-weight component | A-3 | A-2 | A-1 | A-1 |
| | Low-molecular-weight component | B-2 | B-1 | B-1 | B-3 |
| | High-molecular-weight component/low-molecular-weight component | 40/60 | 30/70 | 20/80 | 30/70 |
| | Peak molecular weight on higher molecular weights | 230000 | 805000 | 400000 | 410000 |
| | Peak molecular weight on lower molecular weights | 12300 | 15300 | 15100 | 14400 |
| | Weight average molecular weight | 113000 | 350000 | 200000 | 190000 |
| | Number average molecular weight | 8000 | 11000 | 9000 | 11000 |
| | Acid value (mgKOH/g) | 10.8 | 4.5 | 19.1 | 25.1 |

TABLE 2

| | Type | Highest endothermic peak temperature (° C.) | Number average molecular weight | Weight average molecular weight |
|---|---|---|---|---|
| Wax a | Paraffin wax | 75 | 800 | 1100 |
| Wax b | Fischer-Tropsch wax | 101 | 1500 | 2500 |
| Wax c | Higher alcohol wax (hydroxyl value: 70) | 100 | 1000 | 1800 |

TABLE 3

| | | | Example 1 | Example 2 | Example 3 | Example 4 | Example 5 | Example 6 |
|---|---|---|---|---|---|---|---|---|
| Formulation | Developer No. | | 1 | 2 | 3 | 4 | 5 | 6 |
| | Binder resin | | C-1 | C-1 | C-1 | C-1 | C-3 | C-3 |
| | Charge control agent | | A | A | A | A | B | A |
| | Wax | | b | b | b | b | c | a |
| | Magnetic iron oxide particles | | Octahedron | Octahedron | Octahedron | Octahedron | Multinuclear | Multinuclear |
| | Zeta potential of toner particles (mV) | | 42.0 | 42.0 | 42.0 | 42.0 | 39.9 | 40.5 |
| | Inorganic fine powder | Kind | Alumina | Alumina | ZnO | MgO | ZnO | Alumina |
| | | Amount added (mass %) | 0.2 | 0.1 | 0.2 | 0.2 | 0.5 | 0.5 |
| | | Zeta potential (mV) | 36.5 | 36.5 | 8.3 | 44.3 | 8.3 | 36.5 |
| | Silica fine powder | Kind | a | a | a | a | b | b |
| | | Methanol concentration at transmitance of 80% (vol %) | 75 | 75 | 75 | 75 | 69 | 69 |
| Physical properties of developer | Unconfined yield strength (kPa) | At major consolidation stress of 5 kPa | 0.6 | 0.8 | 1.1 | 0.8 | 0.5 | 0.4 |
| | | At major consolidation stress of 20 kPa | 4.2 | 4.5 | 4.3 | 3.8 | 4.1 | 5.3 |
| | Peak particle size (X) | | 6.25 | 6.25 | 6.25 | 6.25 | 5.71 | 6.91 |
| | Half width (Y) | | 3.90 | 3.90 | 3.90 | 3.90 | 3.12 | 7.21 |

TABLE 3-continued

| | | | | | | | |
|---|---|---|---|---|---|---|---|
| | Liberation ratio of inorganic fine powder (%) | 1.0 | 0.4 | 1.2 | 2.1 | 2.5 | 2.9 |
| | Acid value (mgKOH/g) | 5.5 | 5.5 | 5.5 | 5.5 | 18.4 | 14.5 |
| | THF insoluble matter (mass %) | 41.0 | 41.0 | 41.0 | 41.0 | 2.5 | 2.1 |
| | Main peak molecular weight of THF soluble matter | 12500 | 12500 | 12500 | 12500 | 15100 | 15200 |
| | Content of THF soluble matter having molecular weight of 100,000 or less (mass %) | 80 | 80 | 80 | 80 | 71 | 73 |

| | | | Example 7 | Comparative Example 1 | Comparative Example 2 | Comparative Example 3 | Comparative Example 4 | Comparative Example 5 |
|---|---|---|---|---|---|---|---|---|
| Formulation | Developer No. | | 7 | 8 | 9 | 10 | 11 | 12 |
| | Binder resin | | C-1 | C-2 | C-4 | C-1 | C-1 | C-2 |
| | Charge control agent | | B | C | B | A | A | C |
| | Wax | | a/b | c | a | b | b | C |
| | Magnetic iron oxide particles | | Octahedron | Octahedron | Octahedron | Octahedron | Multinuclear | Octahedron |
| | Zeta potential of toner particles (mV) | | 41.2 | 32.4 | 39.3 | 42.0 | 40.9 | 32.4 |
| | Inorganic fine powder | Kind | ZnO | $TiO_2$ | $SiO_2$ | — | $TiO_2$ | Alumina |
| | | Amount added (mass %) | 0.2 | 0.5 | 0.3 | — | 0.2 | 2.1 |
| | | Zeta potential (mV) | 8.3 | 2.1 | −9.5 | — | 2.1 | 36.5 |
| | Silica fine powder | Kind | b | a | a | b | a | a |
| | | Methanol concentration at transmitance of 80% (vol %) | 69 | 75 | 75 | 69 | 75 | 75 |
| Physical properties of developer | Unconfined yield strength (kPa) | At major consolidation stress of 5 kPa | 0.9 | 2.6 | 2.8 | 1.2 | 0.8 | 0.3 |
| | | At major consolidation stress of 20 kPa | 5.4 | 5.9 | 6.1 | 6.2 | 5.8 | 6.3 |
| | Peak particle size (X) | | 5.84 | 5.00 | 7.21 | 6.25 | 6.30 | 5.45 |
| | Half width (Y) | | 5.54 | 2.35 | 6.87 | 3.90 | 5.62 | 4.22 |
| | Liberation ratio of inorganic fine powder (%) | | 1.5 | 3.3 | 1.6 (*1) | — | 1.7 | 6.1 |
| | Acid value (mgKOH/g) | | 5.8 | 1.5 | 22.5 | 5.5 | 5.3 | 1.8 |
| | THF insoluble matter (mass %) | | 39.0 | 0.1 | 2.6 | 41.0 | 40.0 | 0.2 |
| | Main peak molecular weight of THF soluble matter | | 15500 | 15500 | 15000 | 12500 | 12600 | 15400 |
| | Content of THF soluble matter having molecular weight of 100,000 or less (mass %) | | 81 | 69 | 72 | 80 | 81 | 68 |

(*1) Measurement was made using a sample prepared in the same manner except that the silica fine powder a was not added.

TABLE 4

| | Results of evaluation at high temperature and high humidity (32° C./80% RH) | | | |
|---|---|---|---|---|
| | Initial | | After 200,000 - sheet running | |
| | Image density | Fogging | Image density | Fogging |
| Example 1 | 1.43 | 1.0 | 1.39 | 2.3 |
| Example 2 | 1.43 | 0.9 | 1.41 | 1.0 |
| Example 3 | 1.41 | 1.2 | 1.37 | 1.4 |
| Example 4 | 1.42 | 1.3 | 1.41 | 1.3 |
| Example 5 | 1.48 | 1.5 | 1.36 | 1.8 |
| Example 6 | 1.43 | 1.2 | 1.40 | 1.4 |
| Example 7 | 1.40 | 1.5 | 1.35 | 1.8 |
| Comparative Example 1 | 1.35 | 2.0 | 1.27 | 3.2 |
| Comparative Example 2 | 1.33 | 1.9 | 1.15 | 4.5 |
| Comparative Example 3 | 1.42 | 1.0 | 1.38 | 1.5 |
| Comparative Example 4 | 1.40 | 1.1 | 1.35 | 1.8 |
| Comparative Example 5 | 1.22 | 2.5 | 1.08 | 3.9 |

TABLE 5

| | Results of evaluation at normal temperature and normal humidity (23° C./60% RH) | | | | | | | |
|---|---|---|---|---|---|---|---|---|
| | Initial | | After 200,000-Sheet running | | Image | | Line | |
| | Image density | Fogging | Image density | Fogging | quality rank | Consumption (mg/sheet) | width (μm) | Idling test |
| Example 1 | 1.42 | 1.1 | 1.40 | 1.5 | A | 40.9 | 181 | A |
| Example 2 | 1.43 | 1.0 | 1.41 | 1.2 | A | 42.1 | 185 | A |
| Example 3 | 1.41 | 1.0 | 1.40 | 1.1 | A | 43.8 | 188 | A |
| Example 4 | 1.41 | 1.5 | 1.40 | 1.6 | A | 40.4 | 183 | A |
| Example 5 | 1.44 | 1.3 | 1.40 | 2.0 | A | 44.1 | 180 | B |
| Example 6 | 1.42 | 1.2 | 1.41 | 1.5 | B | 46.8 | 195 | B |
| Example 7 | 1.40 | 1.5 | 1.37 | 1.7 | B | 44.8 | 178 | A |
| Comparative Example 1 | 1.38 | 1.8 | 1.32 | 2.1 | C | 47.5 | 161 | C |
| Comparative Example 2 | 1.34 | 1.7 | 1.27 | 3.1 | C | 52.1 | 205 | C |
| Comparative Example 3 | 1.40 | 0.9 | 1.39 | 1.1 | B | 48.3 | 175 | C |
| Comparative Example 4 | 1.41 | 1.0 | 1.37 | 1.3 | C | 45.1 | 170 | C |
| Comparative Example 5 | 1.35 | 1.9 | 1.22 | 2.2 | C | 44.5 | 145 | B |

TABLE 6

| | Results of evaluation at normal temperature and low humidity (23° C./5% RH) | | | |
|---|---|---|---|---|
| | Initial | | After duration of 200,000 sheets | |
| | Image density | Fogging | Image density | Fogging |
| Example 1 | 1.42 | 1.5 | 1.40 | 2.1 |
| Example 2 | 1.42 | 1.1 | 1.41 | 1.3 |
| Example 3 | 1.41 | 1.5 | 1.40 | 2.0 |
| Example 4 | 1.44 | 1.6 | 1.43 | 1.7 |
| Example 5 | 1.42 | 1.7 | 1.41 | 1.9 |

TABLE 6-continued

| | Results of evaluation at normal temperature and low humidity (23° C./5% RH) | | | |
|---|---|---|---|---|
| | Initial | | After duration of 200,000 sheets | |
| | Image density | Fogging | Image density | Fogging |
| Example 6 | 1.40 | 1.2 | 1.38 | 1.5 |
| Example 7 | 1.39 | 1.8 | 1.35 | 2.2 |
| Comparative Example 1 | 1.38 | 2.1 | 1.30 | 2.5 |
| Comparative Example 2 | 1.35 | 2.5 | 1.30 | 2.7 |
| Comparative Example 3 | 1.39 | 1.5 | 1.37 | 1.8 |
| Comparative Example 4 | 1.40 | 1.6 | 1.35 | 2.0 |
| Comparative Example 5 | 1.37 | 2.5 | 1.29 | 3.1 |

<Production Example of Low-Molecular-Weight Component (E-1)>

300 parts by mass of xylene was placed in a four-necked flask, and the air in the container was sufficiently replaced with nitrogen while the contents in the container were stirred. After that, the temperature of the container was raised to reflux the contents.

Under the reflux, a mixed solution of 75.0 parts by mass of styrene, 25.0 parts by mass of n-butyl acrylate, and 2.0 parts by mass of di-tert-butyl peroxide (Initiator 1) was dropped over 4 hours. After that, the resultant was held for 2 hours to complete polymerization. Thus, a low-molecular-weight polymer solution (E-1) was produced.

<Production Example of Low-Molecular-Weight Component (E-2)>

Polymerization was performed in the same manner as in Production example of the low-molecular-weight component E-1 by the use of 79.0 parts by mass of styrene, 21.0 parts by mass of n-butyl acrylate, and 1.0 part by mass of Initiator 1 to produce a low-molecular-weight polymer solution E-2.

<Production Example of Low-Molecular-Weight Component (E-3)>

Polymerization was performed in the same manner as in Production example of the low-molecular-weight component E-1 by the use of 77.0 parts by mass of styrene, 23.0 parts by mass of n-butyl acrylate, and 2.0 parts by mass of Initiator 1 to produce a low-molecular-weight polymer solution E-3.

<Production Example of Low-Molecular-Weight Component (E-4)>

Polymerization was performed in the same manner as in Production example of the low-molecular-weight component E-1 by the use of 72.0 parts by mass of styrene, 24.0 parts by mass of n-butyl acrylate, 4.0 parts by mass of acrylic acid, and 2.0 parts by mass of Initiator 1 to produce a low-molecular-weight polymer solution E-4.

<Production Example of Low-Molecular-Weight Component (E-5)>

Polymerization was performed in the same manner as in Production example of the low-molecular-weight component E-1 by the use of 74.0 parts by mass of styrene, 24.0 parts by mass of n-butyl acrylate, and 1.5 parts by mass of Initiator 1 to produce a low-molecular-weight polymer solution E-5.

<Production Example of High-Molecular-Weight Component (D-1)>

300 parts by mass of xylene was placed in a four-necked flask, and the air in the container was sufficiently replaced with nitrogen while the contents in the container were stirred. After that, the temperature of the container was raised to reflux the contents.

Under the reflux, at first, a mixed solution of 80.0 parts by mass of styrene, 16.0 parts by mass of n-butyl acrylate, 2.0 parts by mass of 2,2-bis(4,4-di-tert-butylperoxycyclohexyl) propane (Initiator 2), and 5.0 parts by mass of methacrylic acid was dropped over 4 hours. After the entire mixed solution had been dropped, the resultant was held for 2 hours to complete polymerization. Thus, a solution of a high-molecular-weight component (D-1) was produced.

<Production Example of High-Molecular-Weight Component (D-2)>

Polymerization was performed in the same manner as in Production example of the high-molecular-weight component D-1 by the use of a mixed solution of 81.0 parts by mass of styrene, 16.0 parts by mass of n-butyl acrylate, 2.0 parts by mass of Initiator 2, and 4.0 parts by mass of methacrylic acid to produce a solution of a high-molecular-weight component (D-2).

<Production Example of High-Molecular-Weight Component (D-3)>

Polymerization was performed in the same manner as in Production example of the high-molecular-weight component D-1 by the use of a mixed solution of 79.0 parts by mass of styrene, 16.0 parts by mass of n-butyl acrylate, 2.0 parts by mass of Initiator 2, and 6.0 parts by mass of methacrylic acid to produce a solution of a high-molecular-weight component (D-3).

<Production Example of High-Molecular-Weight Component (D-4)>

Polymerization was performed in the same manner as in Production example of the high-molecular-weight component D-1 by the use of a mixed solution of 82.0 parts by mass of styrene, 17.5 parts by mass of n-butyl acrylate, 0.6 part by mass of divinylbenzene, 0.4 part by mass of Initiator 2, and 2.0 parts by mass of mono-n-butyl maleate to produce a solution of a high-molecular-weight component (D-4).

<Production Example of High-Molecular-Weight Component (D-5)>

180 parts by mass of deaerated water and 20 parts by mass of a 2 mass % aqueous solution of polyvinyl alcohol was placed in a four-necked flask. Then, a mixed solution of 73.0 parts by mass of styrene, 23.0 parts by mass of n-butyl acrylate, 7.0 parts by mass of mono-n-butyl maleate, 0.005 part by mass of divinylbenzene, and 0.8 part by mass of Initiator 2 was added to the flask. Then, the mixture was stirred to prepare a suspension.

After the air in the flask had been sufficiently replaced with nitrogen, the temperature of the flask was raised to 85° C. to initiate polymerization. After the flask had been held at the temperature for 24 hours, 0.1 part by mass of benzoyl peroxide (half-life 10-hour temperature: 72° C.) was added. The flask was held at the temperature for additional 12 hours to complete the polymerization. After that, the high-molecular-weight polymer was filtered off, washed with water, and dried to produce a high-molecular-weight component (D-S).

<Production Example of High-Molecular-Weight Component (D-6)>

Polymerization was performed in the same manner as in Production example of the high-molecular-weight component D-1 by the use of a mixed solution of 76.0 parts by mass of styrene, 26.0 parts by mass of n-butyl acrylate, 0.005 part by mass of divinylbenzene, 1.0 part by mass of Initiator 2, and 7.0 parts by mass of methacrylic acid to produce a solution of a high-molecular-weight component (D-6).

<Production Example of High-Molecular-Weight Component (D-7)>

70.0 parts by mass of styrene, 24.0 parts by mass of n-butyl acrylate, 4.0 parts by mass of mono n-butyl maleate, 0.005 part by mass of divinylbenzene, and 1.5 parts by mass of Initiator 2 were used in the same manner as in Production example of the high-molecular-weight component (D-5) to produce a high-molecular-weight component (D-7).

<Production of Binder Resin (F-1)>

200 parts by mass of a solution of the low-molecular-weight component (E-1) in xylene (corresponding to 60 parts by mass of the low-molecular-weight component) was placed in a four-necked flask. After that, the temperature of the flask was raised, and the contents in the flask were stirred under reflux. Meanwhile, 200 parts by mass of a solution of the high-molecular-weight component (D-1) (corresponding to 40 parts by mass of the high-molecular-weight component) was placed in another container and refluxed. After the solution of the low-molecular-weight component (E-1) and the solution of the high-molecular-weight component (D-1) had been mixed under reflux, an organic solvent was distilled off, and the resultant resin was cooled, solidified, and pulverized. After 95 parts by mass of the mixture of the low-molecular-weight component and the high-molecular-weight component and 5 parts by mass of a glycidyl group-containing vinyl resin a styrene-glycidyl acrylate copolymer, weight average molecular weight: 14,000, epoxy value: 0.1 eg/kg) had been mixed by means of a HENSCHEL MIXER, the resultant mixture was subjected to cross-linking reaction at 200° C. by means of a biaxial extruder. After that, the resultant was cooled at a cooling rate of 1° C./min and then pulverized to produce a binder resin (F-1).

<Production of Binder Resins (F-2) and (F-3)>

Each of binder resins (F-2) and (F-3) was produced in the same manner as in Production example of the binder resin (F-1) by the use of the high-molecular-weight components (D-2) and (D-3).

<Production of Binder Resin (F-4)>

200 parts by mass of a solution of the low-molecular-weight component (E-2) in xylene (corresponding to 70 parts by mass of the low-molecular-weight component) was placed in a four-necked flask. After that, the temperature of the flask was raised, and the contents in the flask were stirred under reflux. 30 parts by mass of the high-molecular-weight component (D-4) was placed in the flask and refluxed. After the solution of the low-molecular-weight component (E-2) and the high-molecular-weight component (D-4) had been mixed under reflux, an organic solvent was distilled off, and the resultant resin was cooled, solidified, and pulverized to produce a binder resin (F-4).

<Production of Binder Resin (F-5)>

200 parts by mass of a solution of the low-molecular-weight component (E-3) in xylene (corresponding to 80 parts by mass of the low-molecular-weight component) and 20 parts by mass of the high-molecular-weight component (D-5) were used in the same manner as in Production example of the binder resin (F-4) to produce a binder resin (F-5).

<Production of Binder Resin (F-6)>

200 parts by mass of a solution of the low-molecular-weight component (E-4) in xylene (corresponding to 80 parts by mass of the low-molecular-weight component) and 20 parts by mass of the high-molecular-weight component (D-6) were used in the same manner as in Production example of the binder resin (F-4) to produce a binder resin (F-6).

<Production of Binder Resin (F-7)>

200 parts by mass of a solution of the low-molecular-weight component (E-5) in xylene (corresponding to 70 parts by mass of the low-molecular-weight component) and 30 parts by mass of the high-molecular-weight component (D-7) were used in the same manner as in Production example of the binder resin (F-4) to produce a binder resin (F-7).

Table 7 shows the acid values, peak molecular weights, and the like of the binder resins (F-1) to (F-7).

<Production Example of Magnesium Oxide Fine Powder 1>

1 equivalent of a water-soluble magnesium salt that had been subjected to purification treatment and 0.90 equivalent of an alkali substance were mixed and allowed to react with each other at 30° C. Then, the reactant was heated together with a reaction mother liquor under a pressure of about 60 kg/cm$^2$ at 100° C. for about 4 hours to produce magnesium hydroxide. Magnesium hydroxide thus obtained was calcined in a kanthal furnace at 1,450° C. for 3 hours. The calcined product was pulverized and classified by means of a pulverizer provided with an airflow classifying mechanism to produce a magnesium oxide fine powder 1. Table 8 shows the physical property values of the resultant magnesium oxide fine powder 1.

<Production Example of Magnesium Oxide Fine Powder 2>

A magnesium oxide fine powder 2 was produced in the same manner as in Production example 1 of the magnesium oxide fine powder except that the calcination time was changed to 2 hours. Table 8 shows the physical property values of the resultant magnesium oxide fine powder 2.

<Production Example of Magnesium Oxide Fine Powder 3>

A magnesium oxide fine powder 3 was produced in the same manner as in Production example 1 of the magnesium oxide fine powder except that the baking temperature was changed to 1,150° C. Table 8 shows the physical property values of the resultant magnesium oxide fine powder 3.

<Production Example of Magnesium Oxide Fine Powder 4>

A magnesium oxide fine powder 4 was produced in the same manner as in Production example 1 of the magnesium oxide fine powder except that the baking temperature was changed to 1,750° C. Table 8 shows the physical property values of the resultant magnesium oxide fine powder 4.

<Production Example of Magnesium Oxide Fine Powder 5>

A magnesium oxide fine powder 5 was produced in the same manner as in Production example 1 of the magnesium oxide fine powder except that 0.70 equivalent of the alkali substance was added. Table 8 shows the physical property values of the resultant magnesium oxide fine powder 5.

<Production Example of Magnesium Oxide Fine Powder 6>

A magnesium oxide fine powder 6 was produced in the same manner as in Production example 1 of the magnesium oxide fine powder except that the baking temperature was changed to 1,750° C. and the calcination time was changed to 2 hours. Table 8 shows the physical property values of the resultant magnesium oxide fine powder 6.

<Production Example of Magnesium Oxide Fine Powder 7>

A magnesium oxide fine powder 7 was produced in the same manner as in Production example 6 of the magnesium oxide fine powder except that 0.60 equivalent of the alkali substance was added. Table 8 shows the physical property values of the resultant magnesium oxide fine powder 7.

<Production Example of Magnesium Oxide Fine Powder 8>

A sea water method magnesium oxide fine powder 8 was produced in the same manner as in Production example 3 of the magnesium oxide fine powder except that sea water was used as a magnesium source and calcium lime was used as an alkali source. Table 8 shows the resultant physical property values.

<Production Example of Magnesium Oxide Fine Powder 9>

Vapor-phase oxidation method magnesia (500A manufactured by Ube Material Industries, Ltd.) was used as a magnesium oxide fine powder 9.

Each of the magnesium oxide fine powders 1 to 9 used in the present invention had a peak at a Bragg angle (2θ±0.2 deg) of 42.9 deg in CuKα characteristic X-ray diffraction. Table 8 shows the physical property values of the magnesium oxide fine powders 1 to 9.

Example 8

Binder resin F-1 100 parts by mass

Magnetic iron oxide particles (octahedron, number average particle size: 0.20 μm)

90 parts by mass

Wax b (Fischer-Tropsch wax) 4 parts by mass

Charge control agent A (the triphenylmethane lake pigment) 2 parts by mass

After the above materials had been pre-mixed by means of a HENSCHEL MIXER, the mixture was melted and kneaded by means of a biaxial kneading extruder. The resultant kneaded product was cooled and coarsely pulverized by means of a hammer mill. After that, the coarsely pulverized product was finely pulverized by means of a pulverizer using a jet stream, and the resultant finely pulverized powder was classified by means of a multi-division classifier utilizing a Coanda effect to produce toner particles. The zeta potential of the toner particles was measured. As a result, the pH of a dispersion liquid was 4, and the value of the zeta potential was 41.0 mV.

The following external additives were externally added to and mixed with 100 parts by mass of the toner particles by means of a HENSCHEL MIXER under Conditions 1 (1,700 rpm, 5 minutes), and the mixture was sieved by means of a mesh having an aperture of 150 μm to produce a developer 13. Table 9 shows the internal addition formulation and physical properties of the developer.

Magnesium oxide fine powder 1
0.2 part by mass
Hydrophobic silica fine powder a
0.8 part by mass
Strontium titanate used in Example 1
3.0 parts by mass A 250,000-sheet continuous printing was conducted on a test chart having a printing ratio of 4% in each of an environment of 23° C. and 5% RH, an environment of 23° C. and 60% RH, and an environment of 30° C. and 80% RH by the use of the developer 13 and a commercially available copying machine (IR-105, manufactured by CANON Inc.) modified to have 1.3 times the print speed of an unmodified one.

Evaluation for Image Density

The reflection density of a 5-mm square image was measured by means of a MACBETH DENSITOMETER (manufactured by Gretag Macbeth) with the aid of an SPI filter. Evaluation of image density was made at the initial stage and on the 250,000th sheet. Tables 10 to 12 show the results of the evaluation.

Evaluation of Fogging

A reflection densitometer (Reflectometer model TC-6DS manufactured by Tokyo Denshoku Co., Ltd.) was used to measure the worst value of the reflection density of a white background after image formation and the average reflection density of a transfer material before image formation. The worst value was denoted by Ds, the average reflection density was denoted by Dr, and the value of Ds−Dr was used as a fogging amount to evaluate fogging. Evaluation of fogging was made at the initial stage and on the 250,000th sheet. Tables 10 to 12 show the results of the evaluation.

Evaluation of Tailing

Evaluation of tailing was made as follows. In each environment, at the initial stage and after image formation on 250,000 sheets, a pattern in which a horizontal line of 4 dots is printed on a space of 15 dots with a line width set to be 170 μm was reproduced by using the above image formation testing machine. The image was magnified 100 times by means of an optical microscope, and the number of tailings that had occurred on three horizontal lines observed in a 2.5 mm square on the magnified image was counted.

A: No occurrence.
B: Less than 3.
C: 3 or more and less than 7
D: 7 or more and less than 15
E: 15 or more.

Examples 9 and 10

Each of developers 14 and 15 was produced in the same manner as in Example 8 except that the formulation described in Table 9 was adopted (see Table 7 for a binder resin, Table 2 for a wax, and Table 8 for magnesium oxide). The toner particles in each of the developers 14 and 15 were dispersed into water, and the pH of the dispersion liquid was measured and found to be 4. Table 9 shows the physical properties of the developers thus obtained. Tables 10 to 12 show the results of the same tests as those of Example 8.

It should be noted that the pH of the dispersion liquid prepared by dispersing the toner particles according to each of Examples 11 to 17 and Comparative Examples 6 to 9 into water was 4.

Example 11

A developer 16 was produced in the same manner as in Example 8 except that the formulation described in Table 9 was adopted (see Table 7 for a binder resin, Table 2 for a wax, and Table 8 for magnesium oxide). Magnetic iron oxide particles each having a multinuclear shape were the same as those used in Example 5. Table 9 shows the physical properties of the developer thus obtained. Tables 10 to 12 show the results of the same tests as those of Example 8.

Example 12

A developer 17 was produced in the same manner as in Example 8 except that the formulation described in Table 9 was adopted (see Table 7 for a binder resin, Table 2 for a wax, and Table 8 for magnesium oxide) and conditions for external addition by means of a Henschel mixer were changed to Conditions 2 (1,300 rpm, 1 minute). Magnetic iron oxide particles each having a multinuclear shape were the same as those used in Example 5. Table 9 shows the physical properties of the developer thus obtained. Tables 10 to 12 show the results of the same tests as those of Example 8.

Example 13

A developer 18 was produced in the same manner as in Example 8 except that the formulation described in Table 9 was adopted (see Table 7 for a binder resin, Table 2 for a wax, and Table 8 for magnesium oxide) and conditions for external addition by means of a Henschel mixer were changed to Conditions 3 (2,000 rpm, 8 minutes). Magnetic iron oxide particles each having a multinuclear shape were the same as those used in Example 5. Table 9 shows the physical properties of the developer thus obtained. Tables 10 to 12 show the results of the same tests as those of Example 8.

Example 14

A developer 19 was produced in the same manner as in Example 8 except that the formulation described in Table 9 was adopted (see Table 7 for a binder resin, Table 2 for a wax, and Table 8 for magnesium oxide) and 4 parts of the wax a and 2 parts of the wax b were used. Table 9 shows the physical properties of the developer thus obtained. Tables 10 to 12 show the results of the same tests as those of Example 8.

Example 15

A developer 20 was produced in the same manner as in Example 8 except that the formulation described in Table 9 was adopted (see Table 7 for a binder resin, Table 2 for a wax, and Table 8 for magnesium oxide). Magnetic iron oxide particles each having a multinuclear shape were the same as those used in Example 5. Table 9 shows the physical properties of the developer thus obtained. Tables 10 to 12 show the results of the same tests as those of Example 8.

Example 16

A developer 21 was produced in the same manner as in Example 8 except that the formulation described in Table 9 was adopted (see Table 7 for a binder resin, Table 2 for a wax, and Table 8 for magnesium oxide). Magnetic iron oxide particles each having a multinuclear shape were the same as those used in Example 5. Table 9 shows the physical properties of the developer thus obtained. Tables 10 to 12 show the results of the same tests as those of Example 8.

Example 17

A developer 22 was produced in the same manner as in Example 8 except that the formulation described in Table 9 was adopted (see Table 7 for a binder resin, Table 2 for a wax, and Table 8 for magnesium oxide). Magnetic iron oxide particles each having a multinuclear shape were the same as those used in Example 5. Table 9 shows the physical properties of the developer thus obtained. Tables 10 to 12 show the results of the same tests as those of Example 8.

Comparative Examples 6 to 9

Each of developers 23 to 26 was produced in the same manner as in Example 8 except that the formulation described in Table 9 was adopted (see Table 7 for a binder resin, Table 2 for a wax, and Table 8 for magnesium oxide). Table 9 shows the physical properties of the developers thus obtained. Tables 10 to 12 show the results of the same tests as those of Example 8. The spherical magnetic material used had a number average particle size of 0.20 μm. The tin oxide fine powder used had a particle size of 0.30 μm, an isoelectric point of 6.6, a zeta potential of −12.1 mV at pH=4, and a BET specific surface area of 35.0 $m^2/g$. The titanium oxide fine powder used had a particle size of 0.27 μm, an isoelectric point of 5.0, a zeta potential of 1.5 mV at pH=4, and a BET specific surface area of 7.1 $m^2/g$.

TABLE 7

| | | F-1 | F-2 | F-3 | F-4 | F-5 | F-6 | F-7 |
|---|---|---|---|---|---|---|---|---|
| Formulation | High-molecular-weight component | D-1 | D-2 | D-3 | D-4 | D-5 | D-6 | D-7 |
| | Low-molecular-weight component | E-1 | E-1 | E-1 | E-2 | E-3 | E-4 | E-5 |
| | High-molecular-weight component/low-molecular-weight component | 40/60 | 40/60 | 40/60 | 30/70 | 20/80 | 20/80 | 30/70 |
| Peak molecular weight on higher molecular weights | | 227000 | 245000 | 232000 | 243000 | 430000 | 221000 | 901000 |
| Peak molecular weight on lower molecular weights | | 12000 | 12100 | 12200 | 16100 | 14300 | 11300 | 12600 |
| Weight average molecular weight | | 121000 | 118000 | 126000 | 131000 | 220000 | 115000 | 380000 |
| Number average molecular weight | | 7000 | 8000 | 9000 | 10000 | 13000 | 11000 | 12000 |
| Acid value (mgKOH/g) | | 12.1 | 7.9 | 19.4 | 5.0 | 25.6 | 28.4 | 6.3 |

TABLE 8

| | Magnesium oxide fine powder | | | | | | | | |
|---|---|---|---|---|---|---|---|---|---|
| | 1 | 2 | 3 | 4 | 5 | 6 | 7 | 8 | 9 |
| X-ray peak half width (deg) | 0.274 | 0.321 | 0.295 | 0.302 | 0.269 | 0.314 | 0.342 | 0.416 | 0.372 |
| MgO content (mass %) | 99.98 | 98.50 | 99.98 | 99.98 | 99.98 | 99.20 | 98.20 | 97.98 | 99.98 |
| Volume average particle size (μm) | 1.1 | 1.3 | 0.3 | 1.8 | 1.2 | 1.4 | 1.4 | 0.52 | 0.05 |
| Cumulative value of the magnesium oxide fine powder having a particle size equal to or smaller than one half the volume average particle size (vol %) | 5.1 | 6.2 | 6.1 | 8.6 | 6.7 | 6.7 | 6.7 | 10.2 | 5.1 |
| Cumulative value of the magnesium oxide fine powder having a particle size equal to or larger than twice the volume average particle size (vol %) | 5.8 | 6.6 | 6.4 | 8.2 | 6.3 | 6.3 | 6.3 | 11.3 | 5.3 |
| Isoelectric point | 13.0 | 12.8 | 13.1 | 12.3 | 9.2 | 13.6 | 8.4 | 12.3 | 12.5 |
| Zeta potential at pH4 (mV) | 41.5 | 38.9 | 40.2 | 40.5 | 37.2 | 39.5 | 36.8 | 35.2 | 40.0 |
| BET specific surface area ($m^2/g$) | 3.7 | 3.2 | 3.5 | 3.1 | 3.4 | 3.1 | 1.2 | 24 | 33.4 |

TABLE 9

| | Ex. 8 | Ex. 9 | Ex. 10 | Ex. 11 | Ex. 12 | Ex. 13 | Ex. 14 |
|---|---|---|---|---|---|---|---|
| Developer No. | 13 | 14 | 15 | 16 | 17 | 18 | 19 |
| Binder resin | F-1 | F-2 | F-2 | F-3 | F-3 | F-4 | F-5 |
| Charge control agent | A | A | A | B | B | B | A |
| Wax | b | b | b | b | a | a | a/b |
| Magnetic iron oxide particles | Octahedron | Octahedron | Octahedron | Multinuclear | Multinuclear | Multinuclear | Octahedron |
| Zeta potential of toner particles (mV) | 41.0 | 40.1 | 40.1 | 41.8 | 41.8 | 38.2 | 45.2 |
| Magnesium oxide fine powder Kind | 1 | 2 | 3 | 4 | 1 | 1 | 5 |
| Magnesium oxide fine powder Amount added | 0.2 | 0.2 | 0.2 | 0.2 | 0.2 | 0.2 | 0.2 |
| Conditions for external addition | 1 | 1 | 1 | 1 | 2 | 3 | 1 |
| Liberation ratio of magnesium oxide fine powder (%) | 3.0 | 3.2 | 3.1 | 3.3 | 3.9 | 0.5 | 3.1 |
| At major consolidation stress of 5 kPa | 2.4 | 2.0 | 2.2 | 1.4 | 1.1 | 2.1 | 2.1 |
| At major consolidation stress of 15 kPa | 3.6 | 4.0 | 4.1 | 3.8 | 3.9 | 4.3 | 3.7 |
| At major consolidation stress of 20 kPa | 4.2 | 5.0 | 5.1 | 5.0 | 5.3 | 5.4 | 4.5 |
| Peak particle size (X) | 6.30 | 6.41 | 6.41 | 6.28 | 6.28 | 6.51 | 6.62 |
| Half width (Y) | 3.82 | 3.93 | 3.93 | 4.01 | 4.01 | 3.90 | 4.12 |
| Acid value (mgKOH/g) | 6.2 | 2.0 | 2.8 | 8.2 | 9.2 | 0.8 | 18.2 |
| THF insoluble matter (mass %) | 38.0 | 41.1 | 41.1 | 37.6 | 37.6 | 30.5 | 41.2 |
| Main peak molecular weight of THF soluble matter | 13100 | 13000 | 12900 | 13100 | 13000 | 16200 | 16000 |
| Content of THF soluble matter having a molecular weight of 100,000 or less (mass %) | 83 | 82 | 82 | 84 | 83 | 78 | 73 |

| | Ex. 15 | Ex. 16 | Ex. 17 | Com. Ex. 6 | Com. Ex. 7 | Com. Ex. 8 | Com. Ex. 9 |
|---|---|---|---|---|---|---|---|
| Developer No. | 20 | 21 | 22 | 23 | 24 | 25 | 26 |
| Binder resin | F-4 | F-1 | F-1 | F-1 | F-6 | F-7 | F-4 |
| Charge control agent | B | B | B | A | C | B | A |
| Wax | c | a | a | b | a | a | c |
| Magnetic iron oxide particles | Multinuclear | Multinuclear | Multinuclear | Octahedron | Octahedron | Spherical | Octahedron |
| Zeta potential of toner particles (mV) | 38.2 | 41.0 | 41.0 | 41.0 | 48.2 | 39.0 | 38.2 |
| Magnesium oxide fine powder Kind | 6 | 7 | 9 | — | 8 | ($SnO_2$) | ($TiO_2$) |
| Magnesium oxide fine powder Amount added | 0.5 | 0.05 | 0.05 | — | 0.5 | (2.5) | (1.5) |

TABLE 9-continued

| | | | | | | | |
|---|---|---|---|---|---|---|---|
| Conditions for external addition | 1 | 1 | 1 | 1 | 2 | 1 | 1 |
| Liberation ratio of magnesium oxide fine powder (%) | 3.4 | 3.4 | 1.2 | — | 4.5 | (4.1) | (4.2) |
| At major consolidation stress of 5 kPa | 1.9 | 1.6 | 2.5 | 2.8 | 1.1 | 2.6 | 3.3 |
| At major consolidation stress of 15 kPa | 4.1 | 4.2 | 4.5 | 4.8 | 4.5 | 5.2 | 5.1 |
| At major consolidation stress of 20 kPa | 5.2 | 5.5 | 5.5 | 5.8 | 6.2 | 6.5 | 6.0 |
| Peak particle size (X) | 6.51 | 6.30 | 6.30 | 6.30 | 5.92 | 6.12 | 6.51 |
| Half width (Y) | 3.90 | 3.82 | 3.82 | 3.82 | 4.32 | 4.21 | 3.90 |
| Acid value (mgKOH/g) | 0.7 | 5.4 | 5.4 | 6.3 | 23.5 | 1.1 | 0.7 |
| THF insoluble matter (mass %) | 30.5 | 38.0 | 38.0 | 38.0 | 36.5 | 43.2 | 30.5 |
| Main peak molecular weight of THF soluble matter | 16100 | 13000 | 13000 | 13100 | 16000 | 16100 | 16000 |
| Content of THF soluble matter having a molecular weight of 100,000 or less (mass %) | 77 | 81 | 81 | 83 | 78 | 64 | 80 |

TABLE 10

| | Results of evaluation at high temperature and high humidity (30° C./80% RH) | | | | | |
|---|---|---|---|---|---|---|
| | Initial | | | After 250,000-sheet running | | |
| | Image density | Fogging | Tailing | Image density | Fogging | Tailing |
| Example 8 | 1.42 | 1.0 | A | 1.41 | 1.1 | A |
| Example 9 | 1.41 | 1.2 | B | 1.40 | 1.5 | B |
| Example 10 | 1.40 | 1.1 | B | 1.40 | 1.5 | B |
| Example 11 | 1.42 | 1.4 | A | 1.40 | 1.6 | B |
| Example 12 | 1.43 | 1.3 | A | 1.40 | 1.4 | B |
| Example 13 | 1.41 | 1.3 | C | 1.39 | 1.5 | C |
| Example 14 | 1.43 | 1.5 | A | 1.40 | 1.9 | B |
| Example 15 | 1.42 | 1.4 | B | 1.39 | 1.7 | B |
| Example 16 | 1.40 | 1.7 | B | 1.37 | 1.9 | C |
| Example 17 | 1.39 | 1.8 | B | 1.35 | 2.0 | C |
| Comparative Example 6 | 1.39 | 1.9 | E | 1.35 | 2.2 | E |
| Comparative Example 7 | 1.33 | 2.5 | E | 1.29 | 2.6 | E |
| Comparative Example 8 | 1.31 | 2.4 | E | 1.25 | 2.8 | E |
| Comparative Example 9 | 1.32 | 2.7 | D | 1.27 | 2.9 | E |

TABLE 11

| | Results of evaluation at normal temperature and normal humidity (23° C./60% RH) | | | | | |
|---|---|---|---|---|---|---|
| | Initial | | | After 250,000-sheet running | | |
| | Image density | Fogging | Tailing | Image density | Fogging | Tailing |
| Example 8 | 1.43 | 1.1 | A | 1.42 | 1.2 | A |
| Example 9 | 1.42 | 1.3 | B | 1.41 | 1.5 | B |
| Example 10 | 1.42 | 1.3 | A | 1.40 | 1.5 | B |
| Example 11 | 1.42 | 1.5 | A | 1.40 | 1.4 | B |
| Example 12 | 1.43 | 1.5 | A | 1.40 | 1.6 | B |
| Example 13 | 1.43 | 1.3 | B | 1.39 | 1.4 | C |
| Example 14 | 1.42 | 1.7 | A | 1.40 | 1.9 | B |
| Example 15 | 1.42 | 1.4 | B | 1.39 | 1.5 | B |
| Example 16 | 1.43 | 1.8 | B | 1.37 | 2.0 | C |
| Example 17 | 1.41 | 1.9 | B | 1.36 | 1.9 | C |
| Comparative Example 6 | 1.39 | 1.8 | E | 1.36 | 2.1 | E |
| Comparative Example 7 | 1.37 | 2.1 | D | 1.32 | 2.7 | E |
| Comparative Example 8 | 1.34 | 2.5 | E | 1.29 | 2.9 | E |
| Comparative Example 9 | 1.36 | 2.7 | D | 1.31 | 3.1 | E |

TABLE 12

| Results of evaluation at normal temperature and low humidity (23° C./5% RH) | | | | | | |
|---|---|---|---|---|---|---|
| | Initial | | | After 250,000-sheet running | | |
| | Image density | Fogging | Tailing | Image density | Fogging | Tailing |
| Example 8 | 1.44 | 0.9 | A | 1.43 | 1.0 | A |
| Example 9 | 1.43 | 1.0 | A | 1.42 | 1.1 | B |
| Example 10 | 1.43 | 1.1 | B | 1.42 | 1.3 | B |
| Example 11 | 1.42 | 1.3 | A | 1.42 | 1.3 | B |
| Example 12 | 1.44 | 1.4 | A | 1.42 | 1.5 | B |
| Example 13 | 1.43 | 1.1 | B | 1.40 | 1.2 | C |
| Example 14 | 1.41 | 1.6 | A | 1.40 | 1.8 | A |
| Example 15 | 1.43 | 1.3 | A | 1.39 | 1.6 | B |
| Example 16 | 1.44 | 1.7 | B | 1.38 | 2.0 | C |
| Example 17 | 1.40 | 1.9 | B | 1.37 | 2.1 | C |
| Comparative Example 6 | 1.37 | 1.9 | D | 1.35 | 2.3 | E |
| Comparative Example 7 | 1.38 | 2.5 | D | 1.30 | 2.6 | E |
| Comparative Example 8 | 1.35 | 2.7 | E | 1.28 | 3.0 | E |
| Comparative Example 9 | 1.37 | 2.9 | E | 1.30 | 3.3 | E |

Example 18

A commercially available digital copying machine IR105 (manufactured by CANON Inc.) modified as described below was used in which the peripheral portion of the transferring device of the copying machine was modified to be of a transfer belt type shown in FIG. 5, the photosensitive member of the machine was exchanged for the following photosensitive member 1, and the process speed of the machine main body was set to be 660 mm/sec. A print speed was set to be 110 cpm.

Photosensitive member 1: A positively chargeable a-Si-based photosensitive member having an outer diameter of 108 mm obtained by laminating, on a cylindrical aluminum substrate, a charge injection inhibiting layer formed of an a-Si:H film doped with boron, a photoconductive layer formed of an a-Si:H film doped with boron, and a surface protective layer formed of a silicon film (a-SiC:H) composed of silicon and carbon.

In this example, a developing unit mounted on the IR105 was used for a developing step, and a system was adopted in which an electrostatic latent image on the photosensitive member 11 was subjected to reversal development according to a magnetic one-component jumping development system.

Chloroprene rubber was used as a material for the surface layer of a transfer belt. The amount of the penetration i of the transfer belt with respect to the photosensitive member was set to be 3%. In addition, a bias opposite in polarity to the polarity of the charged toner was applied to a bias roller.

Figure 5:
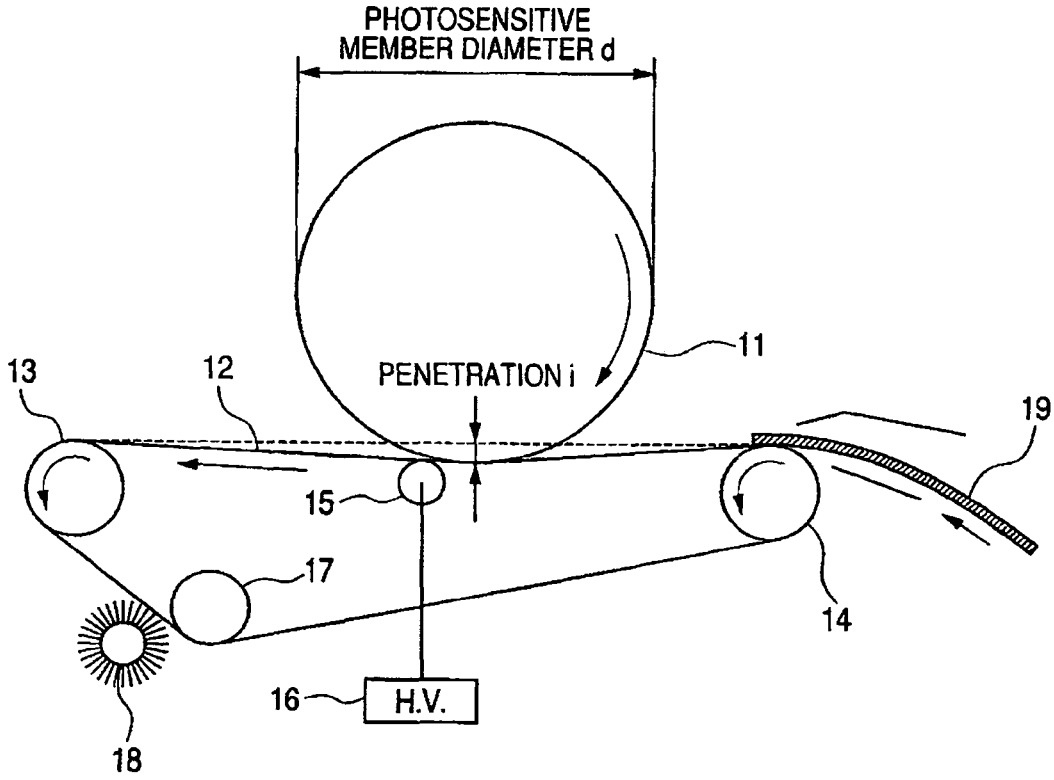
FIG. 5 is a schematic explanatory view of a fixing device.

In the schematic view of the transferring device shown in FIG. 5, a structure was employed in which a transfer belt 12 was brought into press contact with the photosensitive member 11 at all times for convenience of description. However, they are apart from each other when the image forming apparatus is operating or stops operating. In this example, the peripheral speed of the transfer belt was set to be equal to that of the photosensitive member. In FIG. 5, reference numeral 11 denotes the latent image-bearing member (photosensitive member); 12, the transfer belt; 13, a driving roller; 14, a driven roller; 15, the bias roller; 16, a high voltage power supply; 17, a cleaning backup roller; 18, a fur brush; and 19, a transfer material.

A durability test for continuously printing a letter image having an image ratio of 4% on each of 300,000 sheets of A4 paper horizontally fed was performed by the use of the developer 1 in a 23° C./50% RH environment, a 23° C./5% RH environment, and a 32° C./90% RH environment in this order. As a result, in each environment, the contamination of the transfer belt was suppressed well, and excellent results were obtained concerning transfer quality (transfer void, insufficient transfer, and transfer shift) as well.

This application claims priority from Japanese Patent Application Nos. 2004-335421 filed on Nov. 19, 2004 and 2004-335385 filed on Nov. 19, 2004, which are hereby incorporated by reference herein.

What is claimed is:

1. A positively chargeable developer comprising at least positively chargeable toner particles each containing at least a binder resin and magnetic iron oxide, wherein:

an inorganic fine powder is externally added to the positively chargeable toner particles, the inorganic fine powder comprises a magnesium oxide fine powder;

the magnesium oxide fine powder comprises a crystal system having a peak at a Bragg angle (2θ±0.2 deg) of 42.9 deg in CuKα characteristic X-ray diffraction; and a half width of the X-ray diffraction peak at the Bragg angle (2θ±0.2 deg) of 42.9 deg is 0.40 deg or less, an unconfined yield strength ($U_{5kPa}$) at a major consolidation stress of 5.0 kPa of the developer satisfies a relationship of 0.1 kPa≦$U_{5kPa}$≦2.5 kPa; and an unconfined yield strength ($U_{20kPa}$) at a major consolidation stress of 20.0 kPa of the developer satisfies a relationship of 2.5 kPa≦$U_{20kPa}$≦5.5 kPa.

2. A positively chargeable developer according to claim 1, wherein:

a volume average particle size (A) of the magnesium oxide fine powder satisfies a relationship of 0.1 μm≦A≦2.0 μm;

a volume distribution cumulative value of the magnesium oxide fine powder having a particle size equal to or smaller than one half the volume average particle size is 10 vol % or less; and a volume distribution cumulative value of the magnesium oxide fine powder having a particle size equal to or larger than twice the volume average particle size is 10 vol % or less.

3. A positively chargeable developer according to claim 1, wherein an isoelectric point of the magnesium oxide fine powder is 8 to 14.

4. A positively chargeable developer according to claim 1, wherein a specific surface area of the magnesium oxide fine powder is 1.0 to 15.0 $m^2/g$.

5. A positively chargeable developer according to claim 1, wherein an MgO content in the magnesium oxide fine powder is 98.00 mass % or more.

6. A positively chargeable developer according to claim 1, wherein a content (B) of the inorganic fine powder satisfies a relationship of 0.01 mass %≦B≦2.00 mass % on the basis of an entirety of the developer.

7. A positively chargeable developer according to claim 1, wherein a liberation ratio (C) of the inorganic fine powder satisfies a relationship of 0.1%≦C≦5.0%.

8. A positively chargeable developer according to claim 1, wherein a difference between a zeta potential of the positively chargeable toner particles at pH of a dispersion liquid prepared by dispersing the positively chargeable toner particles into water and a zeta potential of the inorganic fine powder at the pH is 40 mV or less.

9. A positively chargeable developer according to claim 1, further comprising a silica fine powder in addition to the inorganic fine powder.

10. A positively chargeable developer according to claim 9, wherein, when wettability of the silica fine powder with respect to a mixed solvent of methanol and water is measured in terms of transmittance of light having a wavelength of 780 nm, a methanol concentration (D) at a transmittance of 80% satisfies a relationship of 65 vol %≦D≦80 vol %.

11. A positively chargeable developer according to claim 1, wherein an acid value ($D_{av}$) of the developer satisfies a relationship of 0.5 mgKOH/g≦$D_{av}$≦20.0 mgKOH/g.

12. An image forming method comprising at least a developing step of developing an electrostatic latent image formed on a latent image-bearing member with a developer layer formed on a developer carrying member to form a developer image, wherein:

torque (T) to be applied to the developer carrying member in a state that the developer layer is formed satisfies a relationship of 0.1 N·m≦T≦50 N·m; and the developer layer comprises the positively chargeable developer according to claim 1.

13. An image forming method according to claim 12, wherein the latent image-bearing member includes: a conductive substrate; a photoconductive layer on the conductive substrate, containing at least amorphous silicon; and a surface protective layer on the photoconductive layer, containing amorphous silicon and/or amorphous carbon and/or amorphous silicon nitride.

* * * * *